US010854370B2

(12) United States Patent
Li et al.

(10) Patent No.: US 10,854,370 B2
(45) Date of Patent: Dec. 1, 2020

(54) EMBEDDED COIL ASSEMBLY AND METHOD OF MAKING

(71) Applicant: Texas Instruments Incorporated, Dallas, TX (US)

(72) Inventors: Haiying Li, Elk Grove, CA (US); Benjamin Michael Sutton, Dallas, TX (US); Ming Li, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 228 days.

(21) Appl. No.: 15/809,750

(22) Filed: Nov. 10, 2017

(65) Prior Publication Data

US 2018/0336994 A1 Nov. 22, 2018

Related U.S. Application Data

(62) Division of application No. 14/576,904, filed on Dec. 19, 2014, now Pat. No. 9,824,811.

(51) Int. Cl.
*H01F 27/28* (2006.01)
*H01F 17/00* (2006.01)
(Continued)

(52) U.S. Cl.
CPC ..... *H01F 27/2804* (2013.01); *H01F 17/0033* (2013.01); *H01F 17/045* (2013.01);
(Continued)

(58) Field of Classification Search
CPC .... H01F 5/003; H01F 17/0033; H01F 17/045; H01F 17/062; H01F 2017/046;
(Continued)

(56) References Cited

U.S. PATENT DOCUMENTS 3,185,947 A 5/1965 Freymodsson
5,055,816 A 10/1991 Altman et al.
(Continued)

FOREIGN PATENT DOCUMENTS

CN 1499914 A 5/2004
CN 101064208 A 10/2007
(Continued)

OTHER PUBLICATIONS

International Search Report No. 20158000694212, dated Jul. 24, 2018, pp. 1-2.
(Continued)

*Primary Examiner* — Peter Dungba Vo
*Assistant Examiner* — Joshua D Anderson
(74) *Attorney, Agent, or Firm* — Dawn Jos; Charles A. Brill; Frank D. Cimino

(57) ABSTRACT

An embedded coil assembly embodiment includes a ferrite ring having an annular axis. The ferrite ring is positioned on a conductive metal surface. A plurality of separate, spaced apart conductive structures extend over the ferrite ring and are attached to the conductive metal surface in a first region of the conductive surface positioned radially outwardly of the annular axis of the ferrite ring and in a second region of the conductive surface positioned radially inwardly of the annular axis of the ferrite ring. An encapsulation layer covers, the ferrite ring and at least a portion of the plurality of conductive structures.

12 Claims, 22 Drawing Sheets

(51) Int. Cl.

| | |
|---|---|
| ***H01F 17/04*** | (2006.01) |
| ***H01F 17/06*** | (2006.01) |
| ***H01F 27/02*** | (2006.01) |
| ***H01F 27/32*** | (2006.01) |
| ***H01F 41/04*** | (2006.01) |
| ***H01F 41/12*** | (2006.01) |

(52) U.S. Cl.
CPC ..... *H01F 17/062* (2013.01); *H01F 27/022* (2013.01); *H01F 27/2895* (2013.01); *H01F 27/327* (2013.01); *H01F 41/041* (2013.01); *H01F 41/127* (2013.01); *H01F 2027/2809* (2013.01); *H01F 2027/2814* (2013.01); *Y10T 29/4902* (2015.01)

(58) Field of Classification Search
CPC .... H01F 27/022; H01F 27/28; H01F 27/2804; H01F 27/2895; H01F 27/327; H01F 2027/2809; H01F 2027/2814; H01F 41/005; H01F 41/04; H01F 41/041; H01F 41/042; H01F 41/043; H01F 41/0458; H01F 41/127; Y10T 29/4902; Y10T 29/49073
See application file for complete search history.

(56) References Cited

U.S. PATENT DOCUMENTS

| | | | |
|---|---|---|---|
| 5,942,963 | A | 8/1999 | Reznik et al. |
| 6,342,778 | B1 | 1/2002 | Catalano et al. |
| 6,417,754 | B1 | 6/2002 | Bernhardt et al. |
| 7,158,005 | B2 | 1/2007 | Pleskach et al. |
| 8,823,480 | B2 | 9/2014 | Dalmia et al. |
| 2002/0095773 | A1 | 7/2002 | Ahn et al. |
| 2004/0113738 | A1 | 6/2004 | Ahn et al. |
| 2004/0130428 | A1 | 7/2004 | Mignano et al. |
| 2004/0189431 | A1 | 9/2004 | Shibata et al. |
| 2006/0145805 | A1 | 7/2006 | Kim et al. |
| 2007/0085648 | A1 | 4/2007 | Lee et al. |
| 2007/0247268 | A1 | 10/2007 | Oya et al. |
| 2008/0186124 | A1 | 8/2008 | Schaffer et al. |
| 2009/0002111 | A1 | 1/2009 | Harrison et al. |
| 2009/0160595 | A1 | 6/2009 | Feng et al. |
| 2010/0013589 | A1 | 1/2010 | Schaffer et al. |
| 2011/0108317 | A1 | 5/2011 | Harrison et al. |
| 2011/0291789 | A1 | 12/2011 | Dalmia et al. |
| 2013/0119511 | A1 | 5/2013 | Shi et al. |
| 2014/0043130 | A1 | 2/2014 | Dalmia et al. |
| 2014/0125446 | A1 | 5/2014 | Saboori et al. |
| 2016/0111196 | A1 | 4/2016 | Francis |
| 2017/0004914 | A1* | 1/2017 | Nishide ..... H01F 17/0013 |

FOREIGN PATENT DOCUMENTS

| | | | |
|---|---|---|---|
| CN | 101814485 | A | 8/2010 |
| CN | 103026431 | A | 4/2013 |
| CN | 105529150 | A | 4/2016 |
| EP | 0986821 | A1 | 3/2000 |
| EP | 1071103 | | 1/2001 |
| JP | 2002501678 | A | 1/2002 |
| JP | 2003234234 | A | 8/2003 |
| JP | 4303707 | | 5/2009 |
| KR | 20130085152 | A | 7/2013 |
| RU | 2523932 | C1 | 7/2014 |
| WO | 9856016 | A1 | 12/1998 |

OTHER PUBLICATIONS

European Patent Office, Supplementary European Search Report, PCT/US2015067228, dated Jul. 20, 2018. pp. 6-8.
The State Intellectual Property Office of P.R.C. Search Report, Application No. 2015800695605, dated Mar. 4, 2019, 3 pages.
Li, Haiying; Sutton, Benjamin Michael; Li, Ming; U.S. Appl. No. 14/576,934, filed Dec. 19, 2014 for "Embedded Coil Assembly and Production Method," 49 pages.
Notification of Transmittal of the International Search Report and the Written Opinion of the International Searching Authority, or the Declaration dated Apr. 7, 2016.
European Patent Office Search Report, PCT/US2015067227, dated Dec. 7, 2018, pp. 1-4.
The State Intellectual Property Office of P.R.C., Chinese Application No. 2015800694212, dated August Aug. 8, 2019.
JP Office Action dated Jan. 29, 2020, 3 pages.

* cited by examiner

EMBEDDED COIL ASSEMBLY AND METHOD OF MAKING

RELATED APPLICATION

This application is a division of application Ser. No. 14/576,904, filed Dec. 19, 2014, entitled EMBEDDED COIL ASSEMBLY AND METHOD OF MAKING, which is hereby incorporated by reference for all that it discloses.

BACKGROUND

Toroidal coil assemblies, including toroidal inductors and toroidal transformers, are passive electronic components. A toroidal coil assembly typically includes a circular ring-shaped (toroidal) magnetic core of high magnetic permeability material such as iron powder or ferrite. In the case of a toroidal inductor, typically a wire is coiled around the toroidal core through the entire circumferential length thereof. For a toroidal transformer, generally a first wire (primary winding) is wrapped around a first half of the circumference of the core and a second wire (secondary winding) is wrapped around the second half of the circumference of the core. In both transformer and inductor coil assemblies, the wire turns are electrically insulated from each other.

Toroidal coil assemblies have long been used in electronic applications. Small toroidal coil assemblies are sometimes embedded in printed circuit boards and in molded block components.

BRIEF DESCRIPTION OF THE DRAWINGS

FIGS. 2 through 11A are cross-sectional side elevation views illustrating various stages in an example method of producing an embedded coil assembly.

FIGS. 31 through 38A are cross-sectional side elevation views illustrating various stages in still another example method of producing an embedded coil assembly.

SUMMARY

An embedded coil assembly is described that includes an annular metal layer having an upper surface, a first plurality of metal pillars arranged in an inner ring on the upper surface of the annular metal layer, a second plurality of metal pillars arranged in an intermediate ring on the upper surface of the annular metal layer and a third plurality of metal pillars arranged in an outer ring on the upper surface of the annular metal layer. A ferrite ring is positioned on the upper surface of the annular metal layer between the first plurality of metal pillars and the second plurality of metal pillars. A plurality of conductive structures each connect corresponding ones of the first plurality of metal pillars and the second plurality of metal pillars. An encapsulation layer covers, the ferrite ring, the first and second plurality of metal pillars, at least a portion of the third plurality of metal pillars and at least a portion of the plurality of conductive structures.

A method of making an embedded coil assembly includes providing a metal layer having a top surface and a bottom surface and patterning and etching the metal layer so as to provide an annular metal layer divided into a plurality of separate circumferential sections.

Another embedded coil assembly includes a ferrite ring having an annular axis. The ferrite ring is positioned on a conductive metal surface. A plurality of separate, spaced apart conductive structures extend over the ferrite ring and are attached to the conductive metal surface in a first region of the conductive surface positioned radially outwardly of the annular axis of the ferrite ring and in a second region of the conductive surface positioned radially inwardly of the annular axis of the ferrite ring. An encapsulation layer covers, the ferrite ring and at least a portion of the plurality of conductive structures.

Another method of making an embedded coil assembly includes placing a ferrite ring, which has an annular axis, on a conductive metal surface. The method includes forming multiple separate, spaced apart conductive structures that extend over the ferrite ring and that are attached to the conductive metal surface in a first region of the conductive surface positioned radially outwardly of the annular axis of the ferrite ring and in a second region of the conductive surface positioned radially inwardly of the annular axis of the ferrite ring. The method also includes encapsulating the ferrite ring and at least a portion of the plurality of conductive structures.

DETAILED DESCRIPTION

Figure 1:
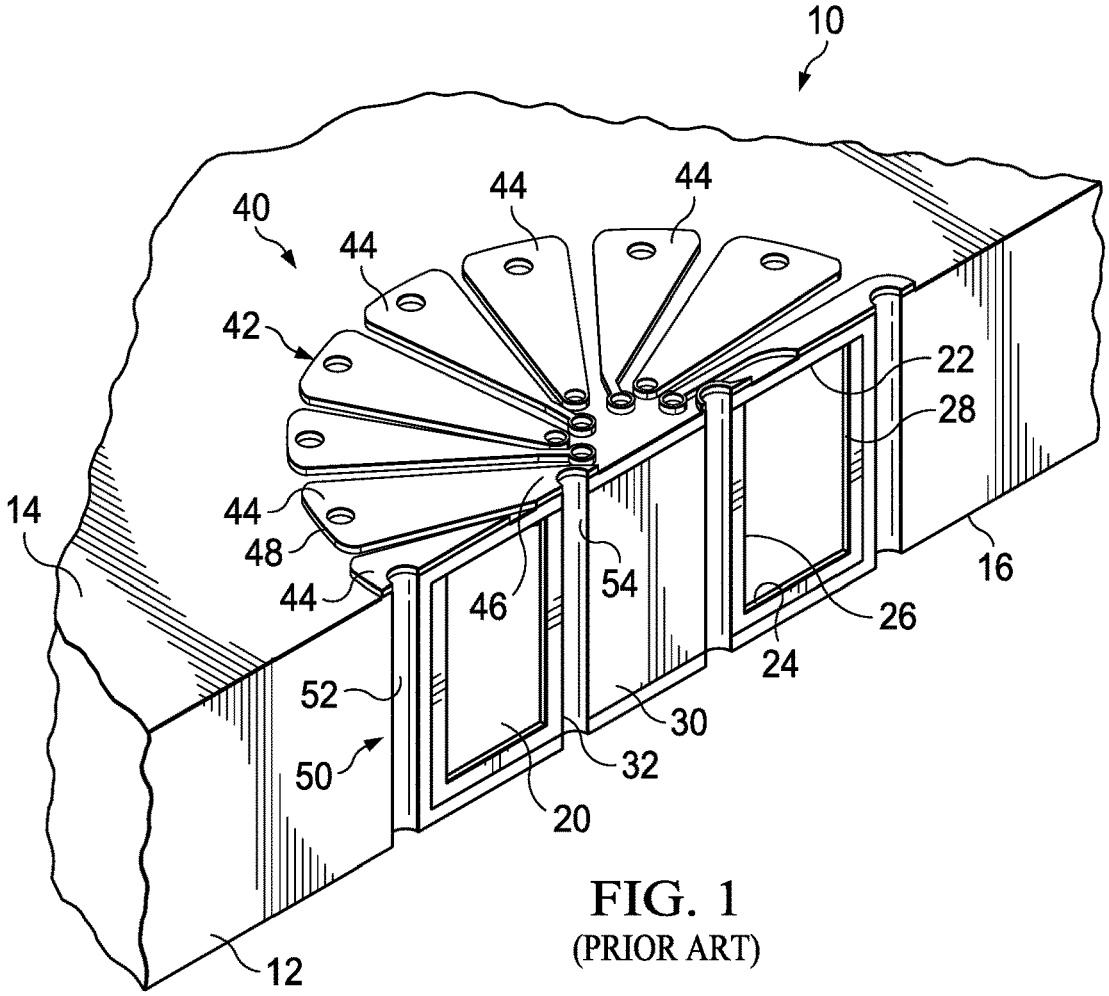
FIG. 1 (PRIOR ART)
FIG. 1 is an isometric cross-sectional view of a prior art embedded coil assembly.

As previously mentioned, small toroidal coil assemblies are often embedded in printed circuit boards and in separate molded components. FIG. 1 is an isometric cross-sectional view of one such prior art embedded coil assembly 10. Coil assembly 10 is formed in an organic substrate 12, such as FR-4, having a top surface 14 and a bottom surface 16. The coil assembly 10 has an annular ("ring shaped"/"toroidal") ferrite core 20. The core 20 has a ring-shaped top surface 22, a ring-shaped bottom surface 24, an inner cylindrical surface 26, and an outer cylindrical surface 28. An epoxy filled central column 30 has a cylindrical outer surface 32, which engages the inner cylindrical surface 26 of the ferrite core 20. A coil winding assembly 40 is partially formed on a top surface 14 of the organic substrate 12 and includes a generally fan shaped, patterned metal layer 42 having a plurality of spaced-apart, radially extending segments 44, each having a radial inner end 46 and a radial outer end 48. A mirror image coil winding assembly (not shown), which provides another portion of the coil winding assembly 40, is formed on the bottom surface 16 of the organic substrate 12. The coil winding assembly 40 also includes a plurality of plated vias 50. Except for lead attachment regions, each of the radially extending segments 44 of the top metal layer 42 is connected by a first plated via 52 at its radially inner end 46 and a second plated via 54 at its radially outer end 48 to corresponding portions of the patterned metal layer on the bottom surface 16 of the substrate. When such an assembly is used to provide small transformers or inductors, production involves drilling and plating a large number of tiny vias. This process is machine-time intensive and expensive.

Another prior art method of providing an embedded coil assembly (not shown) is to hand wrap metal windings about a toroidal ferrite core and then embed the hand wrapped assembly in an organic substrate. Such hand wrapping of small toroidal cores is also extremely time-consuming, labor-intensive and expensive.

This specification discloses several novel embedded coil assemblies and methods of making such embedded coil assemblies. An advantage of some or all of the herein described embedded coil assembly manufacturing methods is the speed and efficiency at which such assemblies may be produced, as compared to the above described prior art methods. These advantages are achieved, at least in part, by using techniques from semiconductor manufacturing technology in a new manufacturing environment involving organic printed circuit boards and stand alone inductor components encased in an organic material, such as, for example, mold compound.

Figure 2:
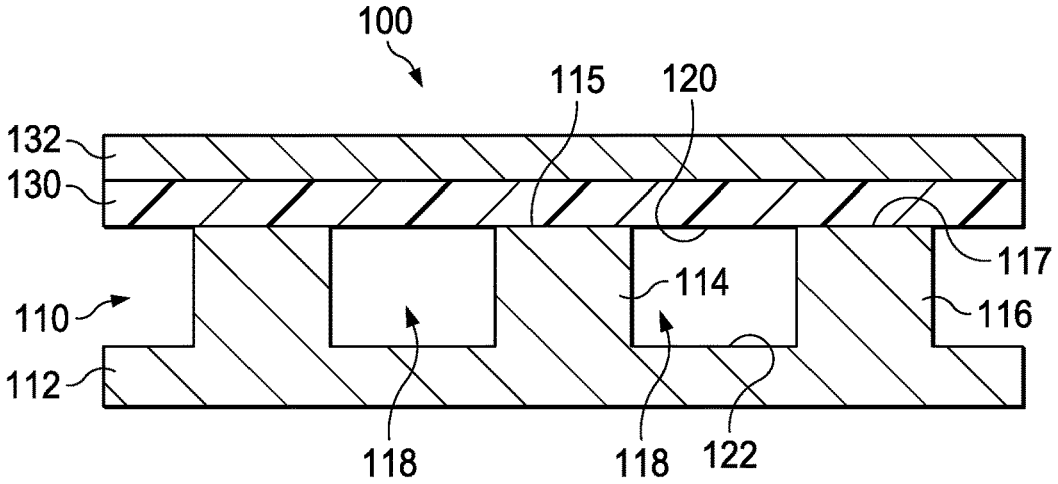

FIGS. 2 through 11A are cross-sectional side elevation views illustrating various stages in an example method of producing an embedded coil assembly. In FIG. 2 an annular metal backing plate or mold 110 has a circular base portion 112. Metal backing plate 110 has an upwardly projecting central column portion 114 with a top surface 115. An annular outer portion 116 has a ring-shaped top surface 117. An annular void 118 is positioned between the central column portion 114 and the annular outer portion 116. The annular void 118 has an open upper end 120 and a closed lower end 122. A photo-definable film layer 130 is supported on the circular top surface 115 and ring-shaped top surface 117 of the central column portion 114 and annular outer portion 116. The metal layer 132 (for example, copper foil layer) is attached to the top surface of the photo-definable film layer 130. Such copper clad photo-definable film layers are known in the art.

Figure 3:
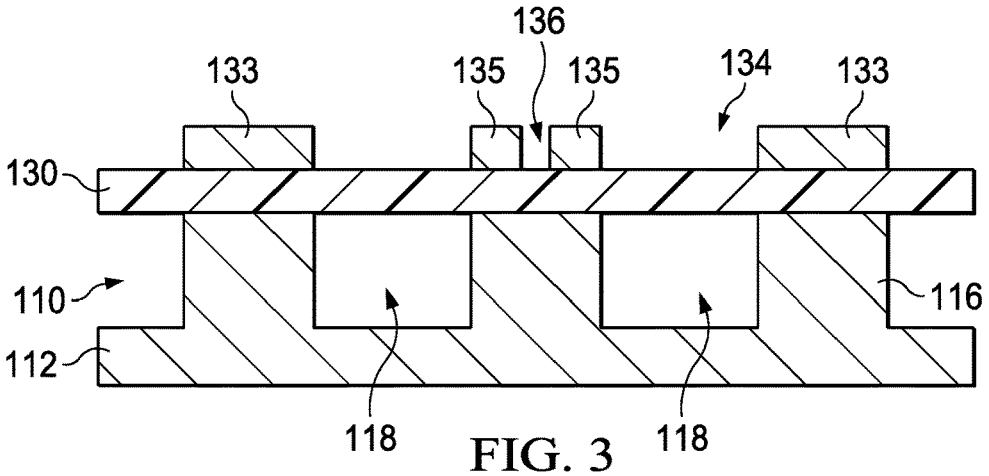

As shown in FIG. 3, the metal layer 132 is patterned and etched to provide an outer annular portion 133, an annular void 134 positioned above void 118, an annular inner portion 135 and a central circular hole 136.

Figure 4:
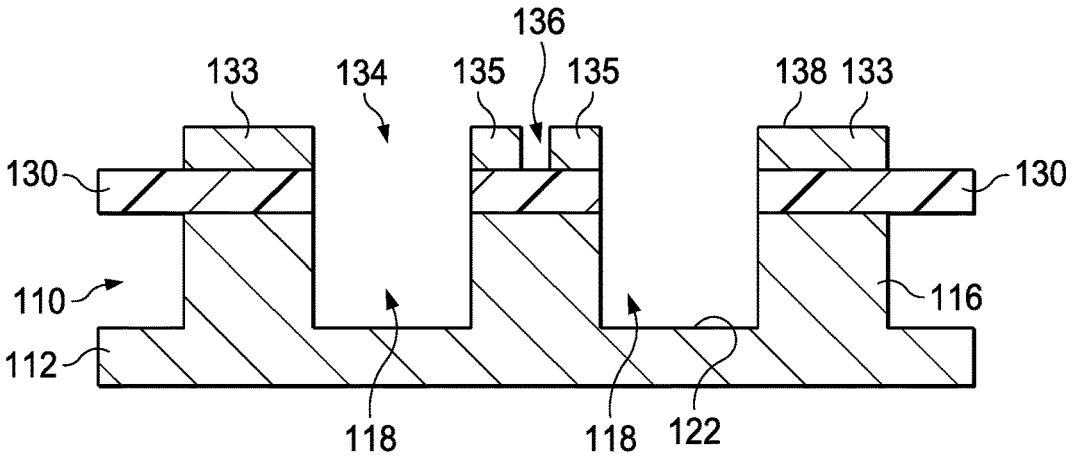

As illustrated in FIG. 4, the portion of the photo-definable film layer 130 positioned below the void 134 and above the void 118 is exposed to light and etched away such that the voids 118 and 134 illustrated in FIG. 4 are now merged and continuous from the bottom surface 122 thereof to the top surface 138 of the metal layer 13. This now merged void is indicated as 118 in FIG. 4.

Figure 5:
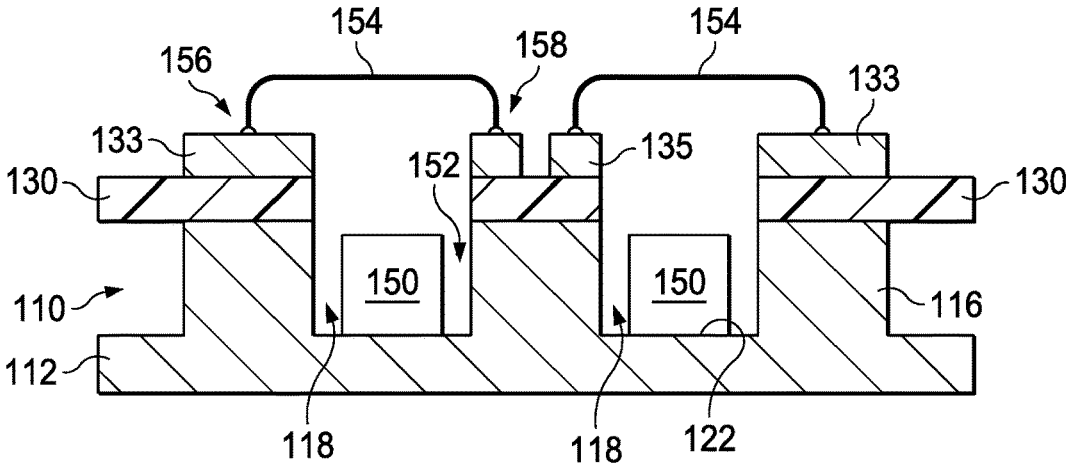
Figure 6:
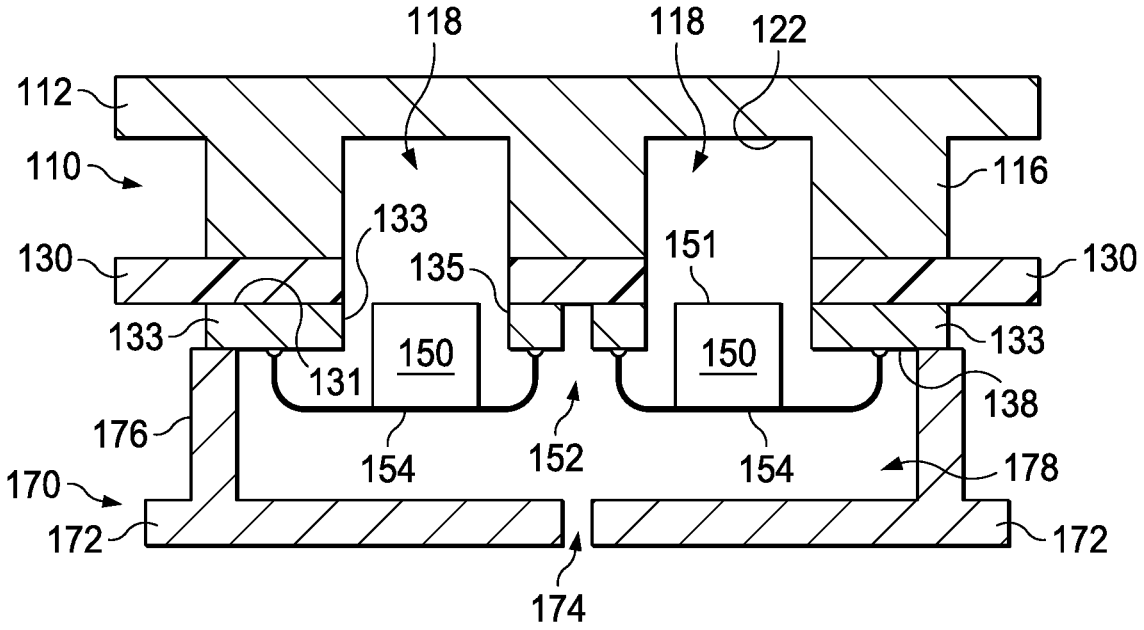

As illustrated in FIG. 5, next a ferrite ring 150 is placed inside the annular void 118 in engagement with surface 122. After placing ferrite ring 150, a plurality of circumferentially spaced-apart bond wires 154 having outer ends 156 and inner ends 158 are attached to the annular outer portion 133 and annular inner portion 135, respectively, of the metal layer 232. The plurality of bond wires 154 are spaced-apart at a predetermined circumferential distance and form a "wire cage" over the ferrite ring 150. Next, a second metal backing plate or mold 170, having a circular laterally disposed portion 172 with a small central hole 174 therein and an annular, vertically projecting wall 176 defining a disc shaped empty space 178, is positioned against the outer annular portion of the metal layer 132. This assembly is then inverted as shown in FIG. 6. As a result of the inversion, the ferrite ring 150 is displaced by gravity downwardly until coming into contact with the bond wires 154, which prevents further downward movement thereof The length of each bond wire 154 is selected such that the ferrite ring 150 comes to rest at a position in which the now upwardly facing surface 151 thereof is positioned at or just below the elevation of the now upwardly facing surface 131 of the metal layer 132.

Figure 7:
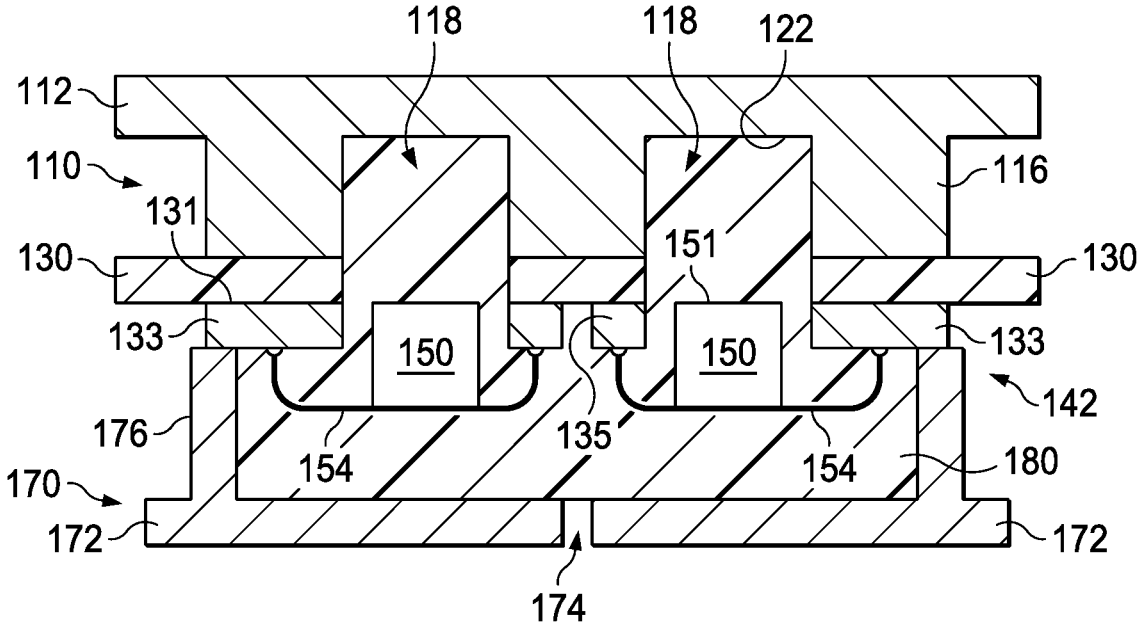

Next, as illustrated in FIG. 7, mold compound 180 is injected into the space 178, covering the ferrite ring 150, the bond wires 154, the inner annular portion 135 and part of the outer annular portion 133.

Figure 8:
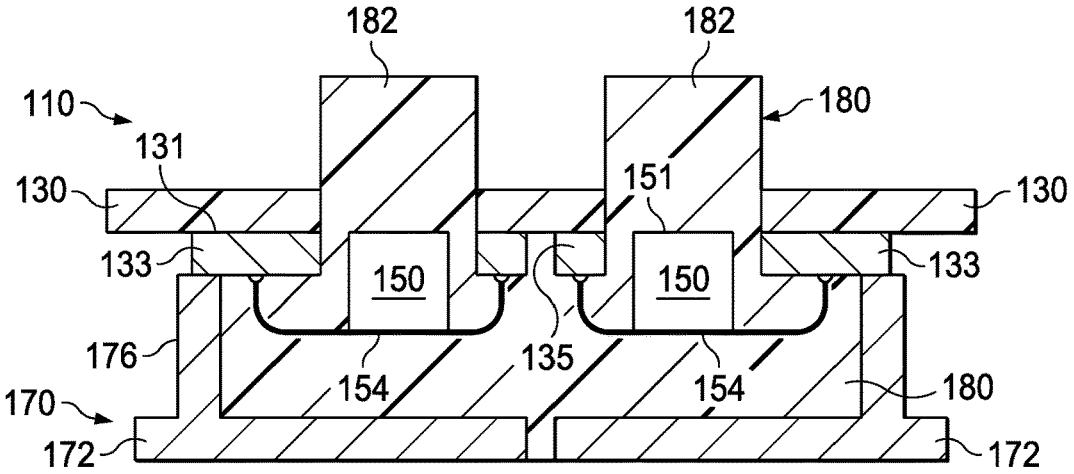

Next, as illustrated in FIG. 8, the metal backing plate/mold 110 is removed and an annular vertically projecting portion of the injected mold compound 180 extends above the support plate 130.

Figure 9:
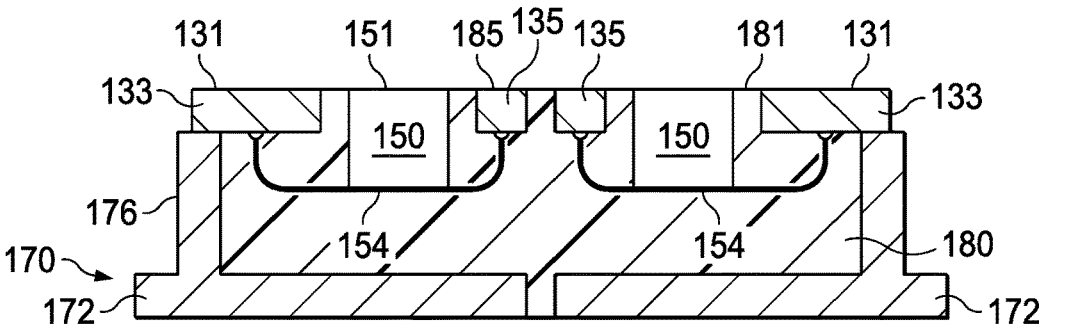

As illustrated in FIG. 9, the photo-definable film layer is then removed and the projections 182 are planed and sanded so that the top surface 181 of the mold compound 180 is now flush with the top surface 151 of the ferrite ring 150 and the top surfaces 131, 185 of the outer and inner metal ring portions 133 and 135.

Figure 10:
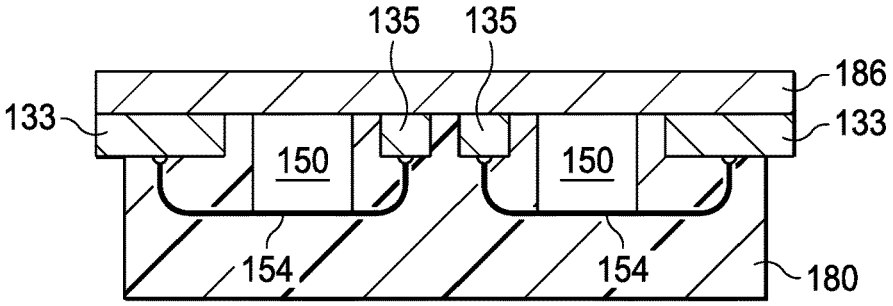

As illustrated in FIG. 10, a metal layer 186 is then plated onto the flat top surface of the assembly.

Figure 11A:
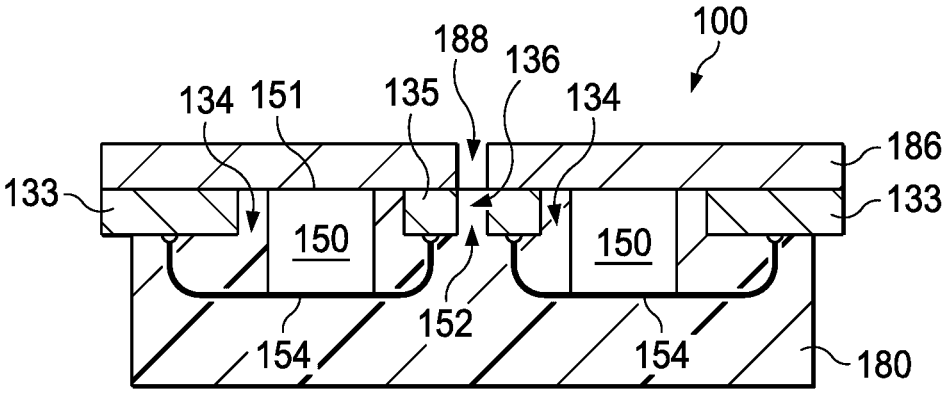
Figure 11B:
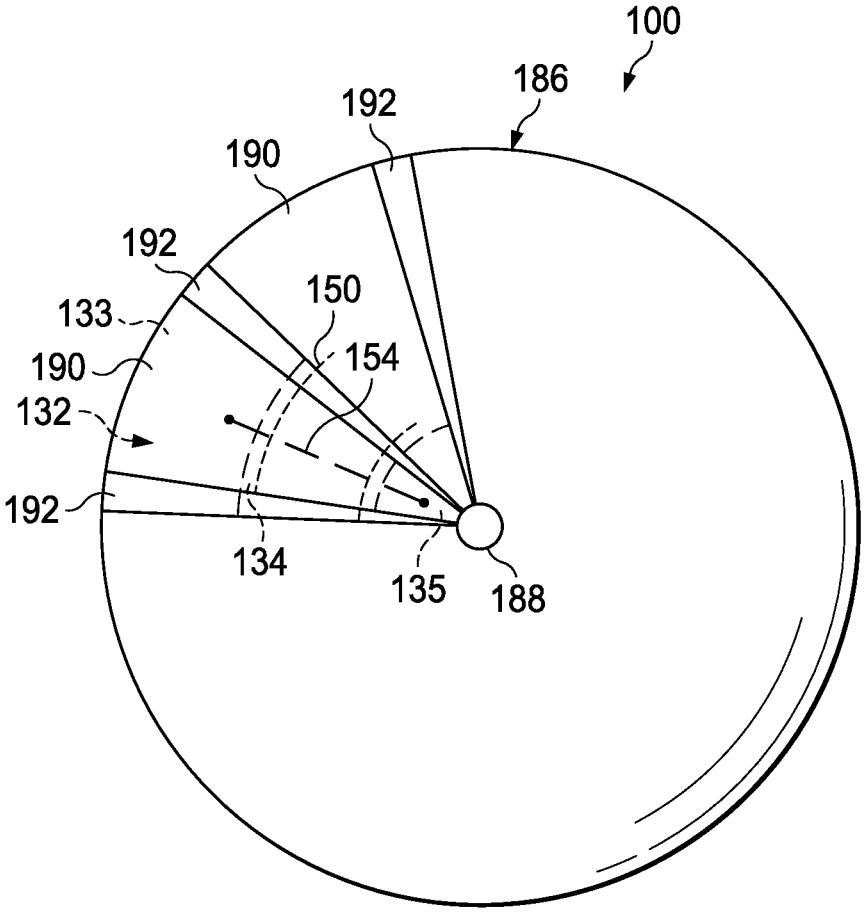
FIG. 11B is atop plan view of FIG. 11A.

Finally, as illustrated in FIG. 11A the top metal layer 186 and the outer and inner annular portions 133, 135 of the metal layer 132 are patterned to provide, along with the bond wires, a plurality of completed windings around the ferrite ring 150. The upper copper layer 186 and the underlying outer and inner annular portions 133, 135 of the metal layer 132 are patterned and etched, as illustrated in FIG. 11B, into a plurality of pie-shaped segments 190, which are separated by pie shaped voids 192. As a result, an embedded coil assembly 100, FIGS. 11A and 11B is provided.

The embedded coil assembly 100, FIGS. 11A, 11B, includes a laterally disposed ferrite ring 150 having a central opening 152. An upper laterally disposed annular metal layer 186 has a central opening 188 aligned with the central opening 152 in the ferrite ring 150 and engages the top surface 151 of the ferrite ring 150. A lower laterally disposed annular metal layer 132 has a central opening 136 aligned with the central opening in the upper metal layer 188 and has an annular void 134 therein separating the annular outer portion 133 from the annular inner portion 135 thereof. The ferrite ring 150 is positioned in the annular void 134.

FIG. 11B is a top plan view of the embedded coil assembly 100 showing the upper metal layer 186 and showing the various portions of the lower metal layer 132 and the ferrite ring 150 in small dashed lines and the bond wires 154 in larger dashed lines. As the result of a final patterning and etching process, the upper annular metal layer 186 and the lower annular metal layer 132 below it are divided into a plurality of circumferential pie-shaped segments 190 that are separated by circumferential spaces 192. Each circumferential segment 190 of the lower metal layer 132 has outer and inner radially-extending portions 133, 135 that are radially separated by a void 134. The outer and inner portions 133, 135 of the lower metal layer 132 engage identically shaped portions of the upper metal layer 186, which are attached thereto. The ferrite ring 150 is located in the annular void 134 of the lower metal layer 132. The plurality of bond wires 154 are connected at opposite ends thereof to the spaced-apart outer and inner portions 133, 135 of the lower metal layer 132 and extend beneath the ferrite ring 150. A layer of mold compound 180, FIG. 11A, engages the ferrite ring 150, the upper and lower metal layers 186, 132 and the bond wires 154.

An embedded coil assembly 200 that is identical to the above described embedded coil assembly 100 may be made by an alternative method as will now be described with reference to FIGS. 12-21.

Figure 12:
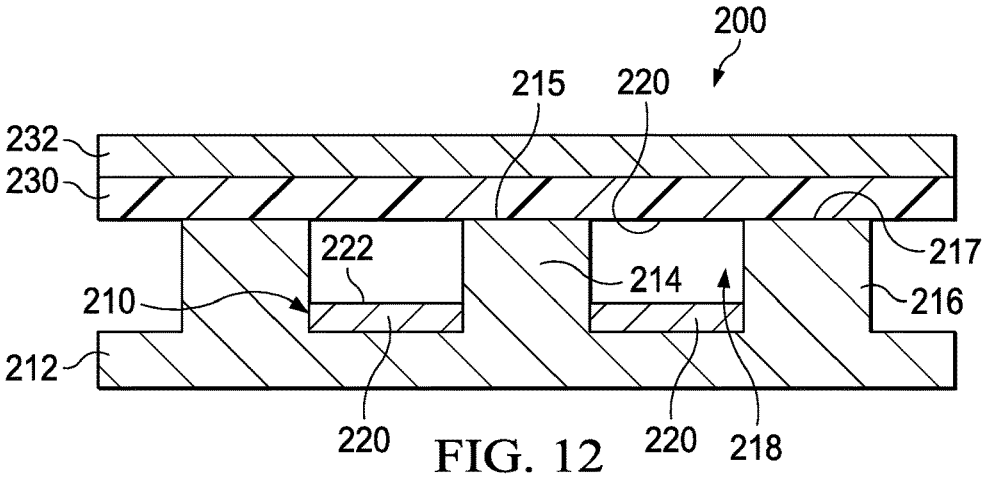
FIGS. 12 through 21 are cross-sectional side elevation views illustrating various stages in another example method of producing an embedded coil assembly.

FIG. 12 is a cross-sectional side elevation view of a variable mold 210. The variable mold 210 has much the same structure as that described above for mold 110. Corresponding structures in the variable mold 210 are indicated by the same reference numerals as used for mold 110, except with 200 series numerals. The variable mold 210 differs from mold 110 in that it has a displaceable seal plate 220 with a central opening 224 therein. The operations performed in FIGS. 12-15 are essentially the same as those described above with reference to FIGS. 2-5.

As shown in FIG. 12 an annular metal backing plate or mold 210 has a circular base portion 212. The metal backing plate 210 includes an upwardly projecting central column portion 214 with a circular top surface 215 and an upwardly projecting annular outer portion 216 with a ring-shaped top surface 217. An annular void 218 is positioned between the central column portion 214 and the annular outer portion 216. The annular void 218 has an open upper end 220. A photo-definable film layer 230 is supported on the circular top surface 215 and the ring-shaped top surface 217 of the central column portion 214 and annular outer portion 216. A face surface of the metal layer (for example, copper foil layer) 232 is attached to a face surface of the photo-definable film layer 230.

Figure 13:
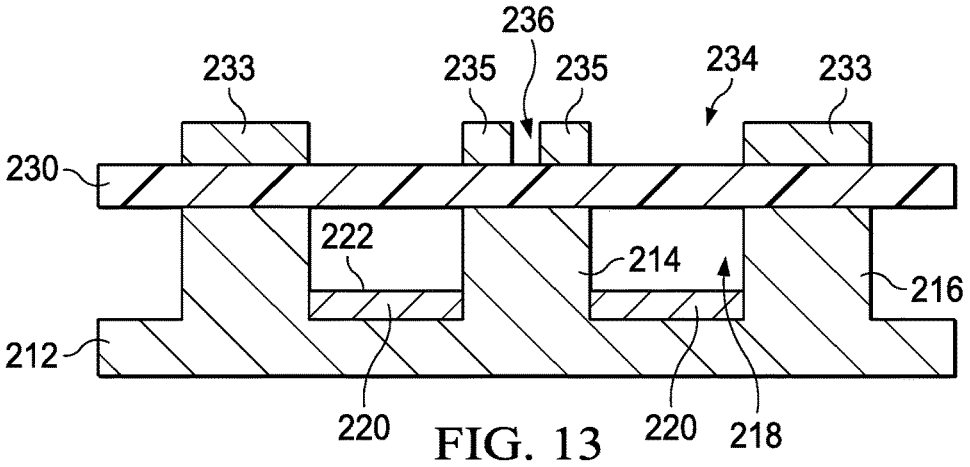

As shown in FIG. 13 the metal layer 232 is patterned and etched to provide an outer annular portion 233, an annular void 234 positioned above void 218, an annular inner portion 235 and a central circular hole 236.

Figure 14:
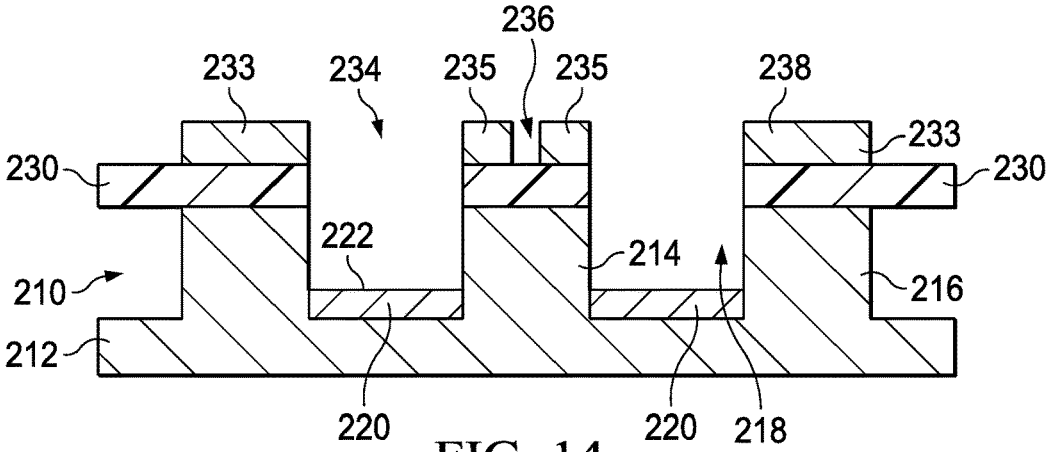

As illustrated in FIG. 14, the portion of the photo-definable film layer 230 positioned below the void 234 and above the void 218 is exposed to light and then etched away, such that the void 218 illustrated in FIG. 13, becomes the elongated void 218. As shown in FIG. 14, the void 218 now extends from the top surface 222 of the displaceable plate 220 to the elevation of the top surface 238 of the metal layer 232.

Figure 15:
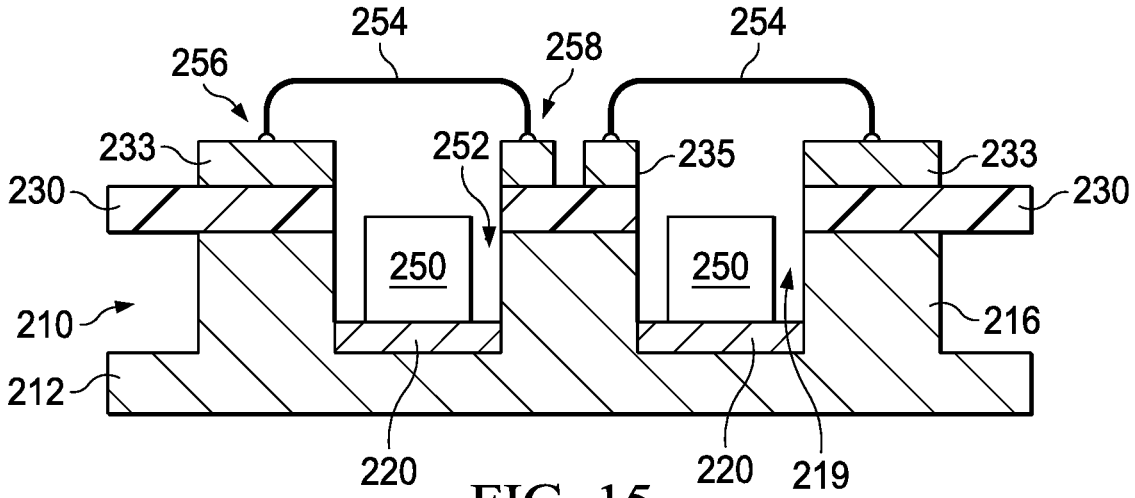

As illustrated in FIG. 15, a ferrite ring 250 is placed inside the annular void 219 and rests on surface 222. After placing the ferrite ring 250, a plurality of circumferentially spaced-apart bond wires 254 having outer ends 256 and inner ends 258 are attached to the annular outer portion 233 and annular inner portion 235, respectively, of metal layer 232. Next, a second metal backing plate/mold 270, having a circular laterally disposed portion 272 with a hole 274 therein and an annular vertically projecting wall 276 defining an empty space 278 is positioned against the outer annular portion 233 of the metal layer 232. This assembly is then inverted as shown in FIG. 16.

Figure 16:
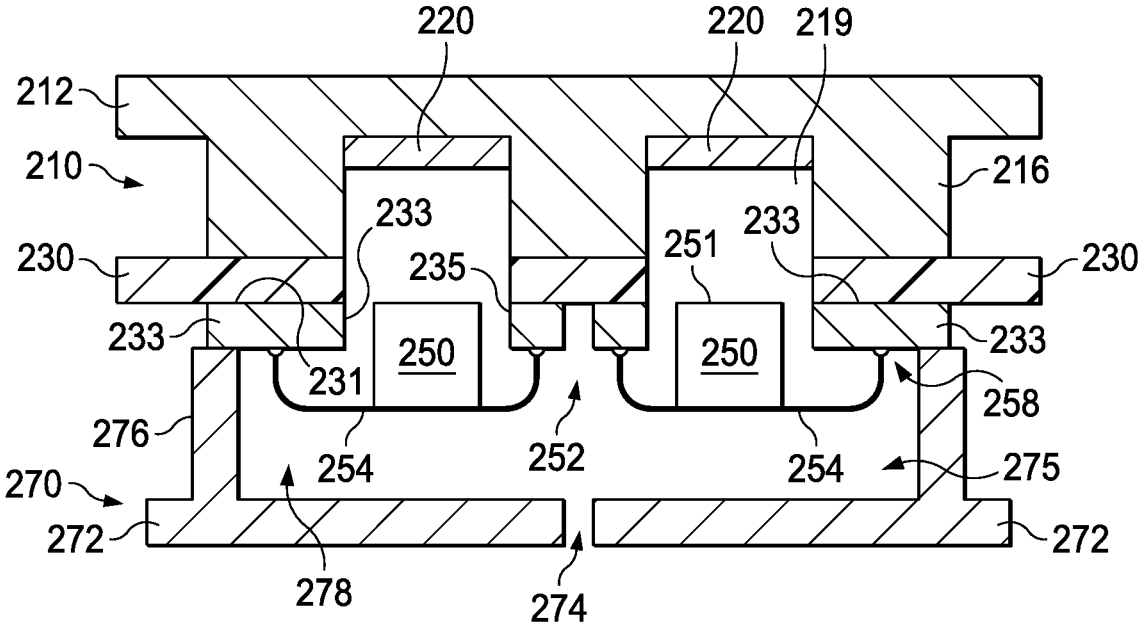

As a result of the inversion, as shown in FIG. 16, the ferrite ring 250 is displaced by gravity downwardly until coming into contact with the bond wires 254, which prevents further downward movement thereof. The length of each bond wire 254 is selected such that the ferrite ring 250 comes to rest at a position in which the now upwardly facing surface 251 thereof is positioned at the same elevation as the now upwardly facing surface 231 of the metal layer 232.

Figure 17:
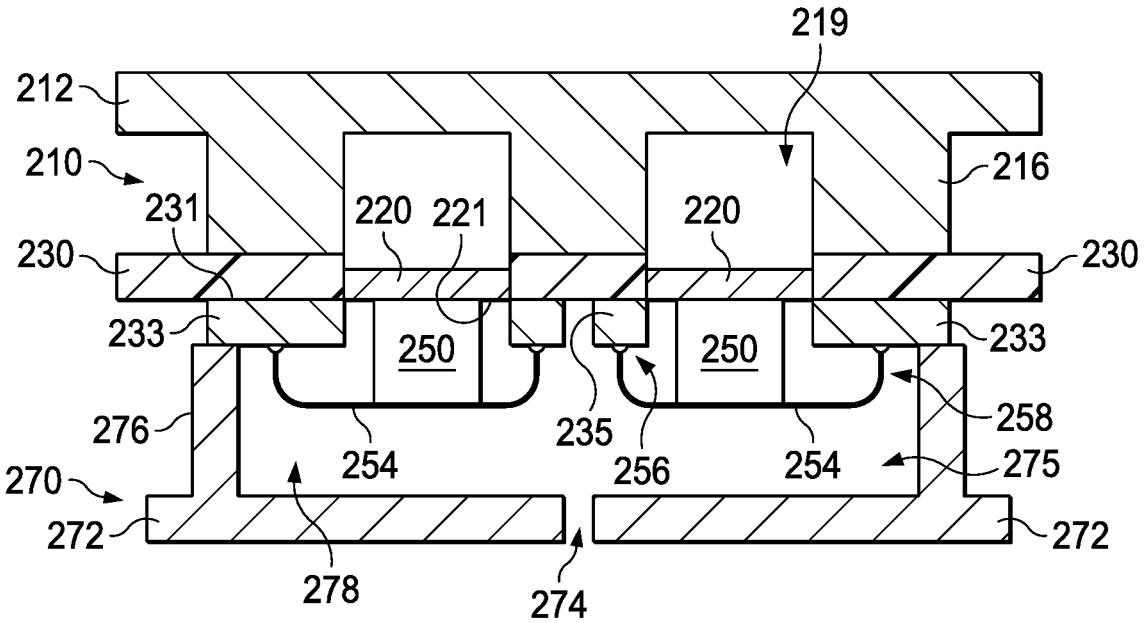
Figure 18:
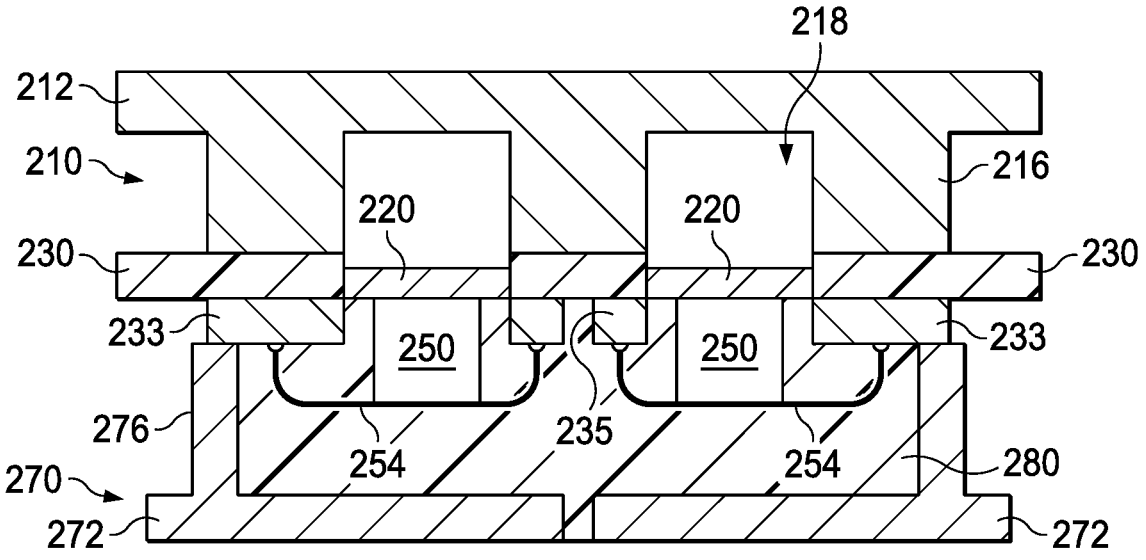

Next, as shown in FIG. 17, the displaceable metal plate 220 is moved downwardly until the now downwardly positioned surface 221 thereof is level with the now upwardly facing surface of the photo-definable film layer 230 and the upwardly facing surface 251 of the ferrite ring 250. Then, as shown in FIG. 18, the cavity 275 defined by the displaceable plate 220 and the lower mold 270 is injected with mold compound 280.

Figure 19:
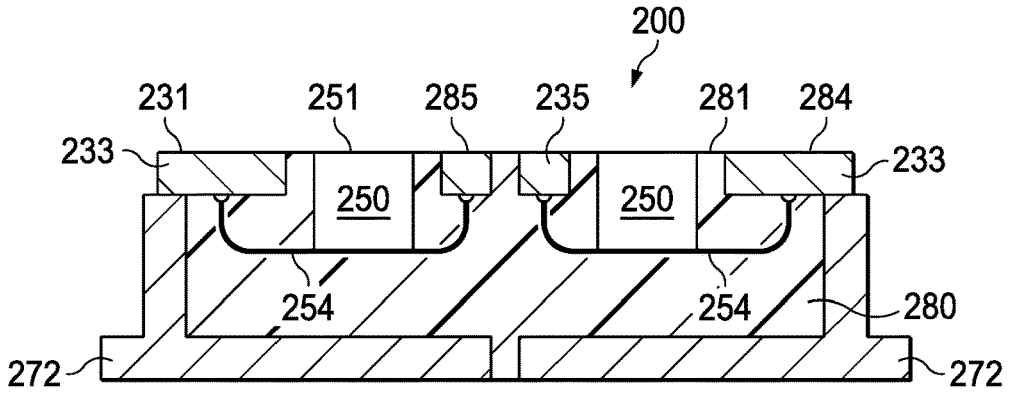

As shown by FIG. 19, after the mold compound 280 cures, the mold 210 is removed/opened and the top surface of the remaining mold compound 281, which is already substantially flat, is further leveled and sanded as needed, such that it is flush with the upper surfaces 231, 285 and 251 of the metal layer 232 and ferrite ring 250.

Figure 20:
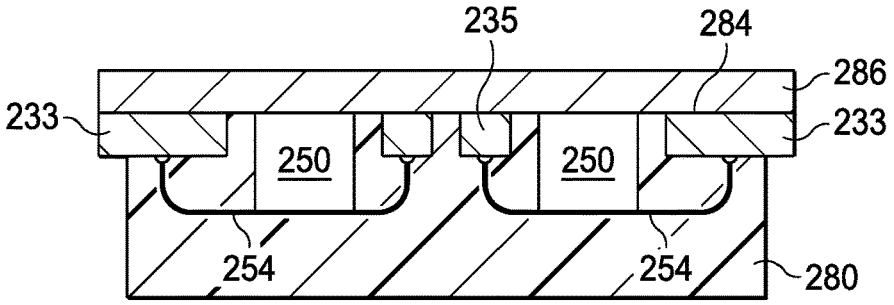
Figure 21:
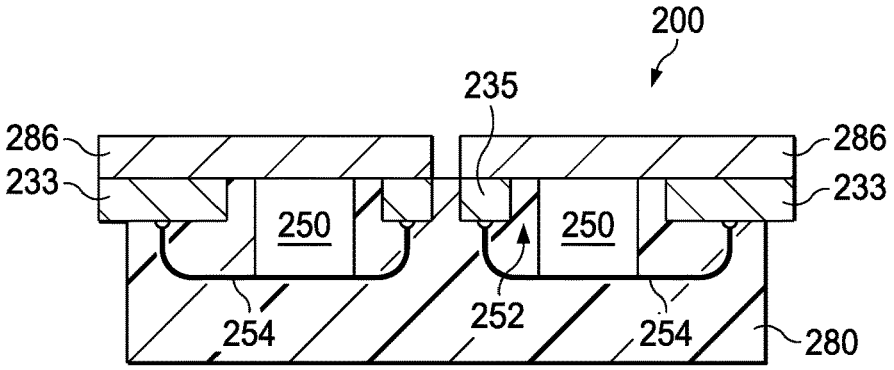

As shown by FIG. 20, the bottom mold 270 is then removed and an upper metal layer 280 is plated onto the flat top surface of the assembly, engaging surfaces 231 and 251. At this point the assembly shown in FIG. 20 is identical to the assembly shown in FIG. 10. Next the operations described above with reference to FIGS. 11A and 11B are performed on the assembly of FIG. 20 resulting in the product 200 shown in FIG. 21, which is substantially the same as that shown in FIGS. 11A and 11B.

Various production stages in a method of making another embedded coil assembly 300 are illustrated in FIGS. 22-30.

Figure 22:
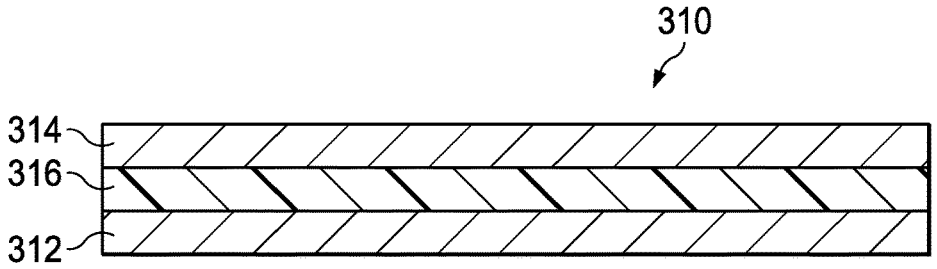
FIGS. 22 through 30 are cross-sectional side elevation views illustrating various stages in a yet another example method of producing an embedded coil assembly.

FIG. 22 is a side elevation view of a printed circuit board ("PCB") prepreg assembly 310. The prepreg assembly 310 includes lower metal layer 312 and an upper metal layer 314, which may both be copper foil layers. Sandwiched between the metal layers 312, 314 is a prepreg layer 316 of composite fiber material in a matrix, for example, glass fabric in epoxy, which is also referred to herein as "composite layer" 316.

Figure 23:
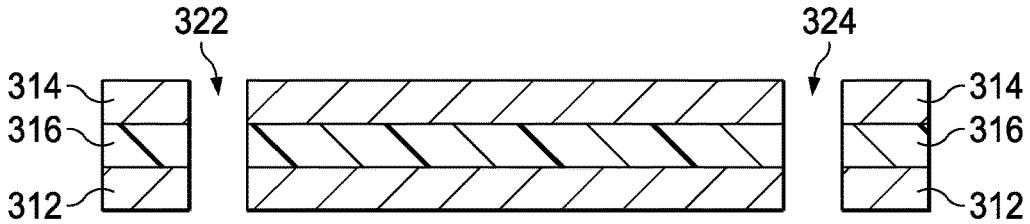
Figure 24:
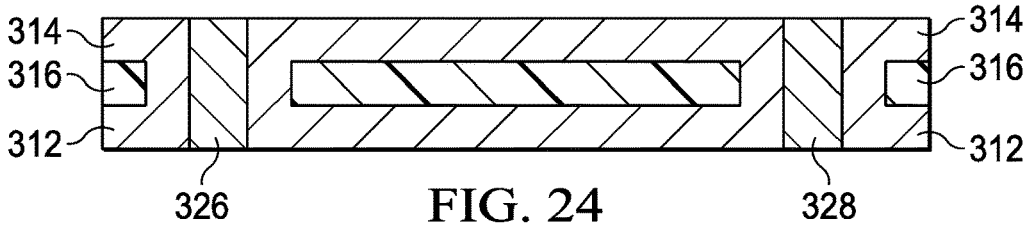

As illustrated in FIG. 23 a plurality of through-holes 322, 324 are drilled around the periphery of the prepreg 310. Through-holes 322, 324 are then plated to provide plated through-holes 326, 328 as illustrated in FIG. 24.

Figure 25:
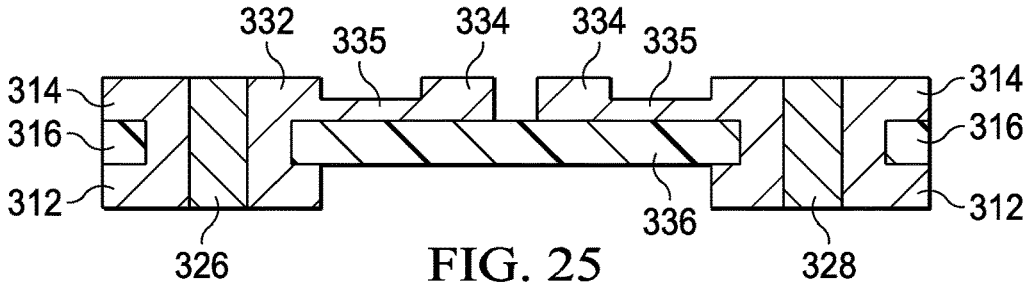

Next, as shown by FIG. 25, a circuit is patterned and etched out on metal layers 312, 314 and 316. This process forms an outer metal ring 332, which includes plated through-holes 326 and 328. The metal ring 332 supports a composite layer bridge 336 at a mid-height of the metal ring 332. An inner metal ring 334 is supported at the top surface of the composite bridge 336. An annular metal bridge 335 is continuous with and connects the two metal rings 332 and 334. In the illustrated embodiment the metal bridge has a height of half the height of each of the metal rings 332 and 334. In other embodiments the annular metal bridge 335 may have the same height as the metal rings 332 and 334 or it may have another height.

Figure 26:
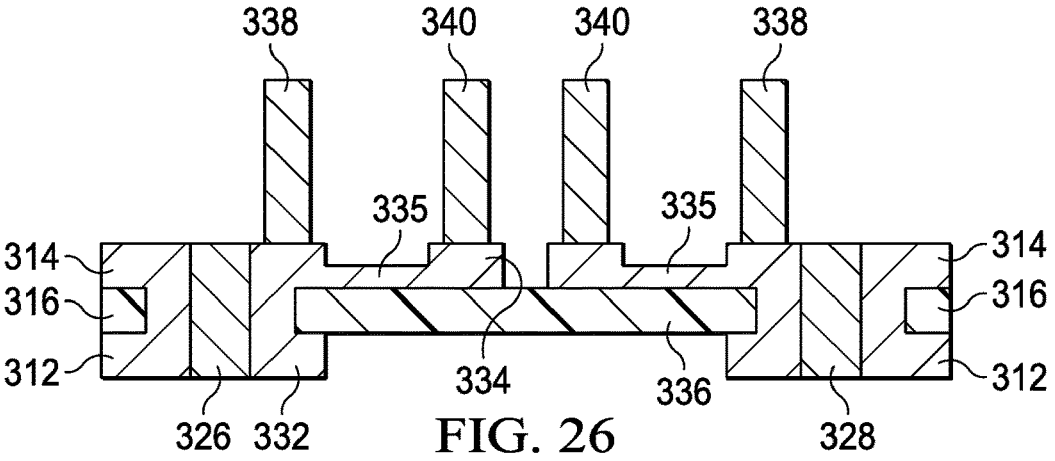

As illustrated by FIG. 26, a first plurality of circumferentially spaced-apart metal pillars 338 are formed on the outer ring 332 and a second plurality of circumferentially spaced-apart pillars 340 are formed on the inner ring 334. In one embodiment these pillars 338 and 340 are produced conventionally and are then conventionally attached at a predetermined spacing to the rings 332, 334. In another embodiment the pillars are printed onto the rings 332 and 334 with a 3-D printer and are then exposed to a high temperature to sinter/fuse the pillars to the rings 332 and 334. In some embodiments the metal pillars 338, 340 are silver or copper.

Figure 27:
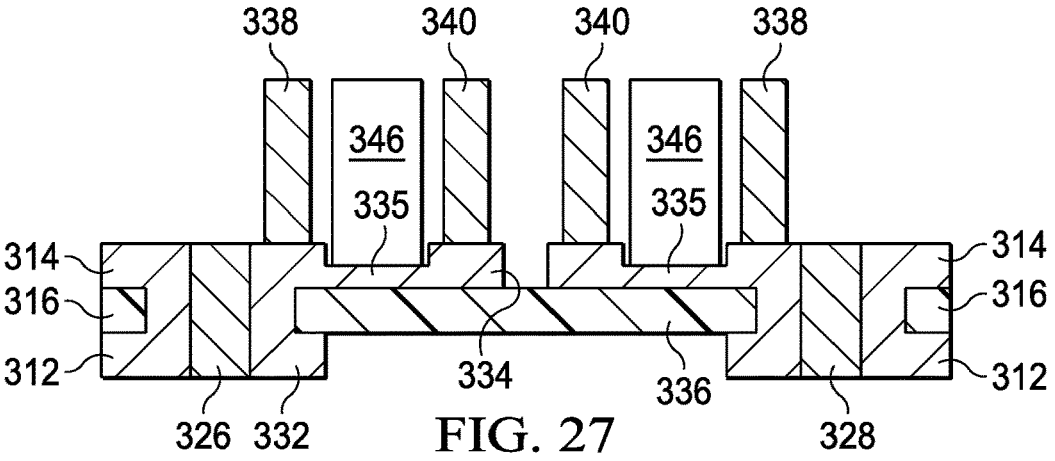

As shown in FIG. 27 a ferrite ring 346 is placed on the annular metal bridge 335 that is supported on the composite bridge 336 in the annular space between the outer pillars 338 and inner ring of pillars 340.

Figure 28:
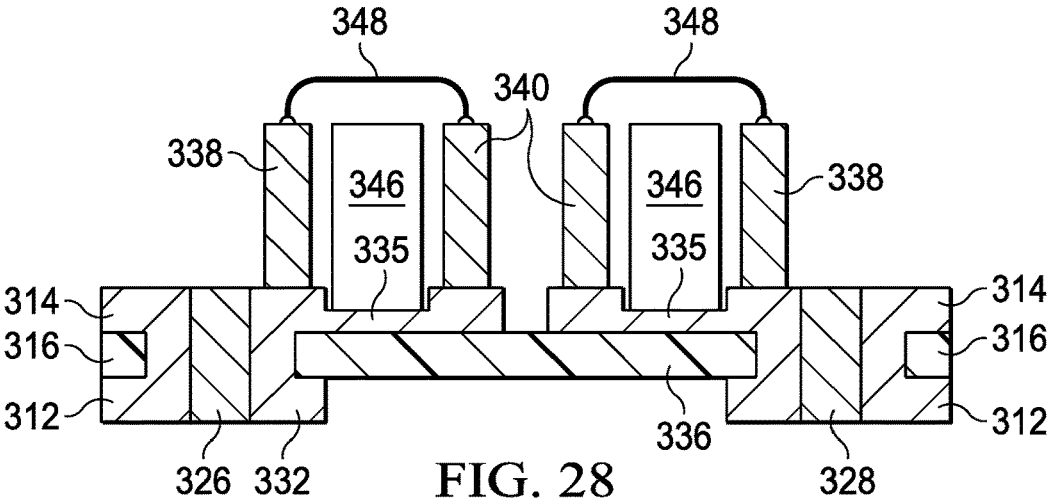

Next, as illustrated in FIG. 28, bond wires 348 are connected between radially aligned pillars in the first plurality of pillars 338 and the second plurality of pillars 340 such that the bond wires 348 extend over the ferrite ring 346.

Figure 29:
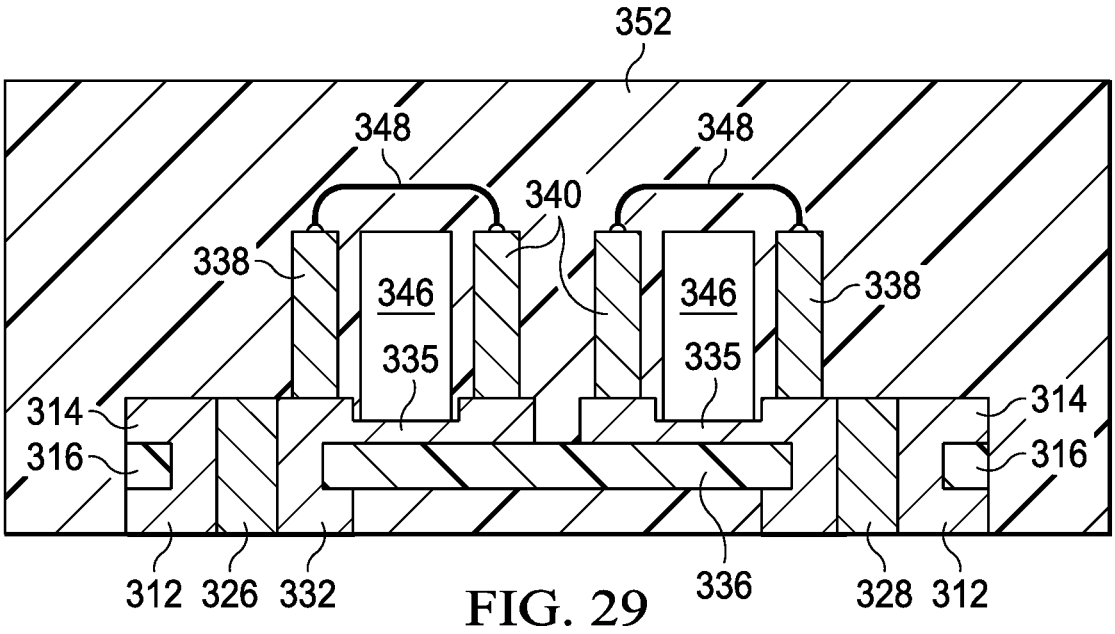

As shown by FIG. 29, the assembly of FIG. 28 is then molded, as by use of a transfer mold, such that a block of mold compound 352 covers the entire assembly leaving only the bottom surface of the outer metal ring 332 exposed.

Figure 30:
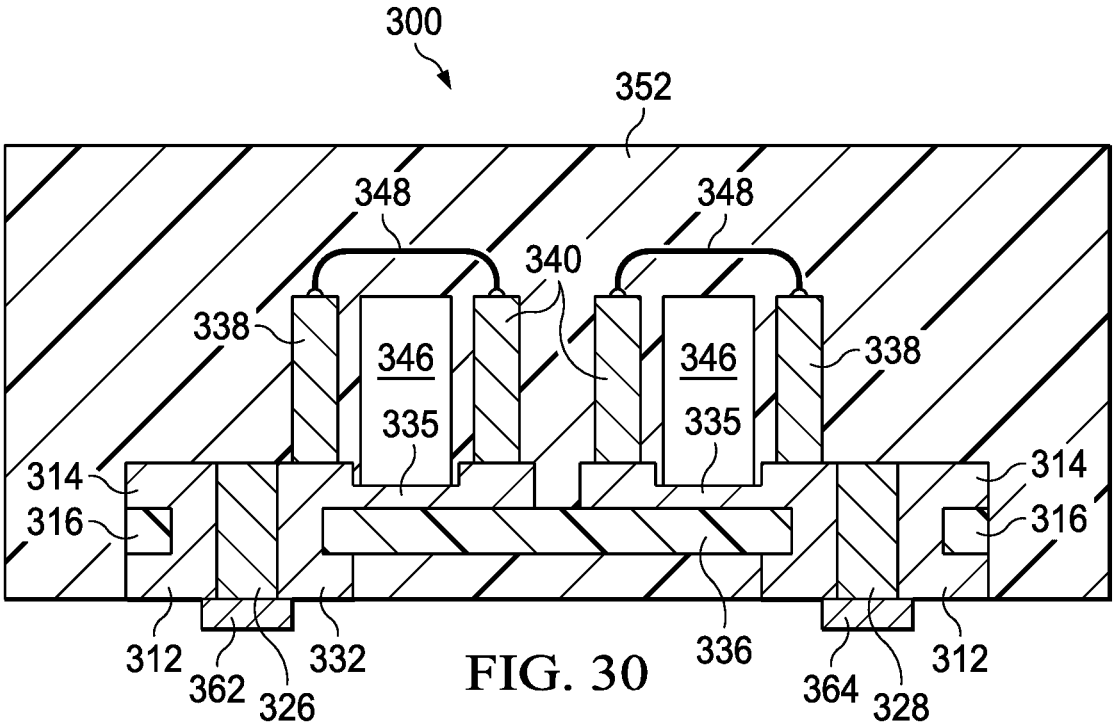

Next, as illustrated in FIG. 30, I/O lead blocks 362, 364 are formed below diametrically opposed plated through-holes 326, 328. In one embodiment the lead blocks 362, 364 are formed in a two step process. First, solder paste is applied and then the solder paste is heated to reflow the solder and fuse it to the metal ring 332 and plated through-holes 328 or 332. In the case where the coil assembly 300 is an inductor coil assembly with a single set of windings there are generally only two plated through-holes 328 and 332. For a typical transformer coil assembly with two sets of windings, one on each circumferential half of the core, there are generally four such I/O lead blocks. The formation of I/O leads 362, 364, etc., may complete the embedded coil assembly 300.

Figure 31:
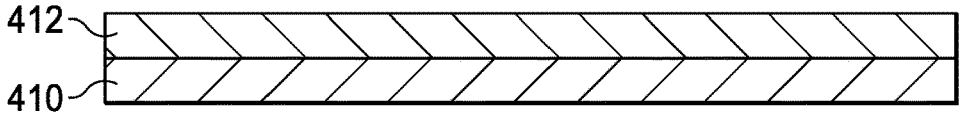
Figure 32:
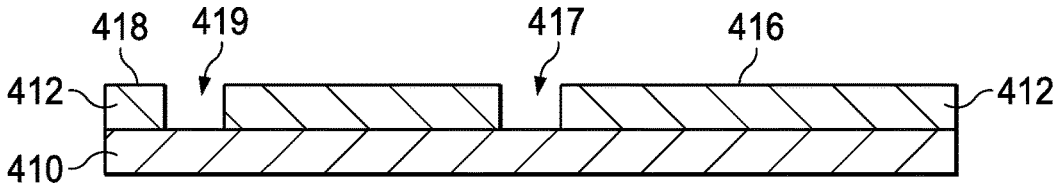

A method of making another embodiment of embedded coil assembly 400 will now be described with reference to FIGS. 31-38. As illustrated in FIG. 31, a base plate 410 has a metal foil layer 412, such as copper clad, formed thereon. Next, as illustrated in FIG. 32, a circuitry pattern is formed in the metal layer 412, which, in this embodiment, includes an annular main body portion 416 with a central hole 419 therein and a separate island portion 418. (In other embodiments no such hole 419 is formed and the metal foil layer is symmetrical after patterning and etching with no separate island 418 being formed.) The main body portion 416 is further patterned into a plurality of separate radially extending portions, which may be pie-shaped portions, similar to those shown in FIG. 11B. The island portion 416 may be a circumferentially short portion formed by a single small hole 419 in a single pie shaped portion. The island portion 416 may be used as one terminal for a circuit (not shown) different and isolated from the coil assembly 400, FIG. 37. In other embodiments, as previously mentioned, this hole 419 is omitted from the coil assembly 400.

Figure 33:
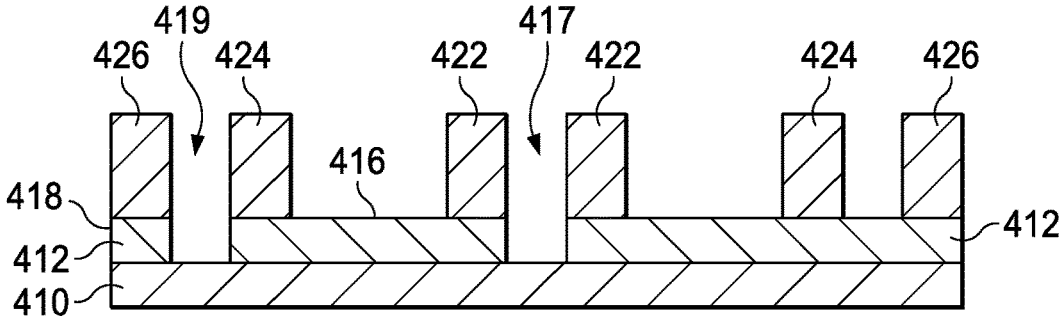
Figure 34:
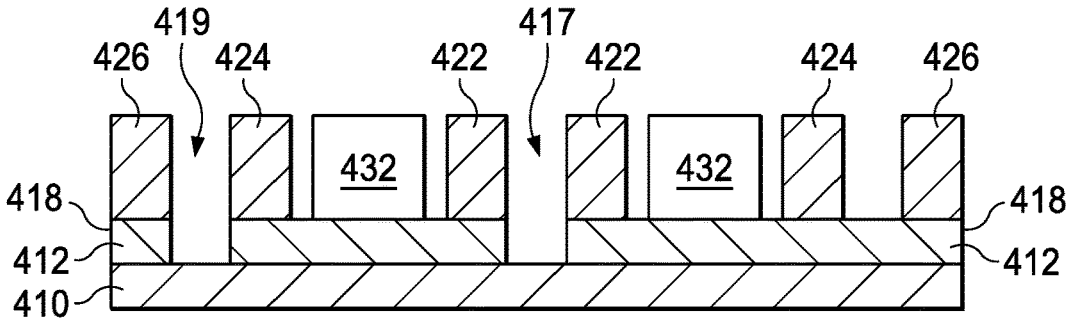

Next, as illustrated by FIG. 33, an inner ring of pillars 422, an intermediate ring of pillars 424 and an outer ring of pillars 426 are sintered or placed on the patterned, annular metal layer 412, one pillar on each radial end and in the radial middle of each pie-shaped portion (except for a radially shortened pie shaped portion aligned with the island 418, which only has two pillars thereon, while the island 418 itself has one pillar thereon). As illustrated by FIG. 33, a ferrite ring 432 is then placed on the metal layer 412 at a position between the inner ring of pillars 422 and the intermediate ring of pillars 424.

Figure 35:
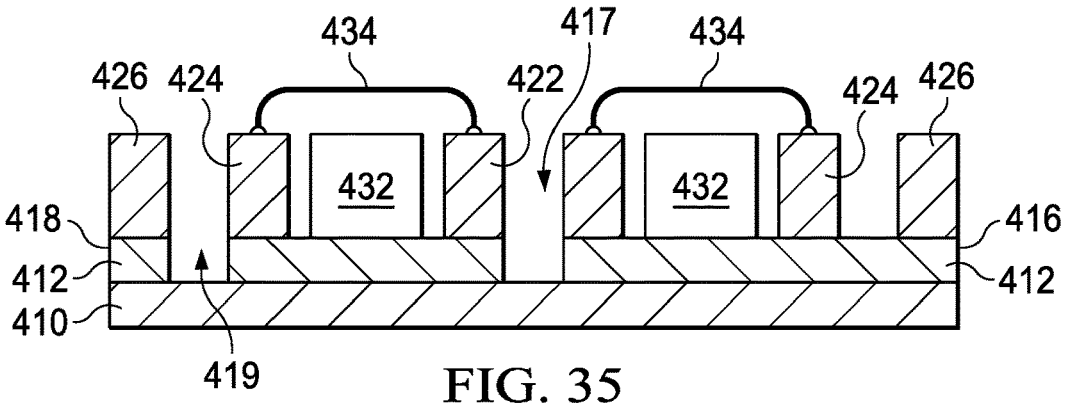

As shown by FIG. 35, bond wires 434 are then attached at opposite ends thereof between pillars in the inner ring of pillars 422 and pillars in the intermediate ring of pillars 424, such that the bond wires 434 extend over the ferrite ring 432.

Figure 36:
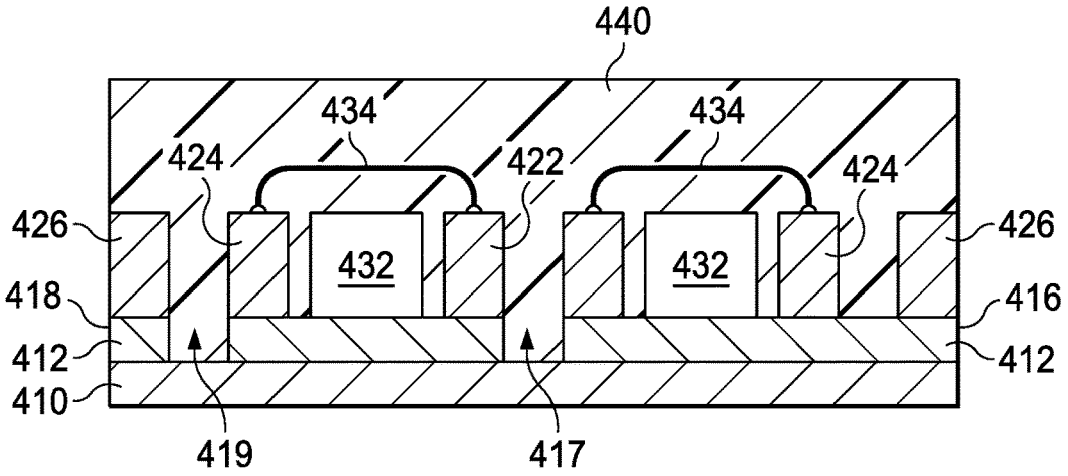

Next, shown by FIG. 36, a layer of mold compound 440 is molded over the metal layer 412, the pillars 422,424,426, the ferrite ring 432 and the bond wires 434. The layer of mold compound 440 also fills the holes 417 and 419. It is to be understood that FIGS. 31-36 each illustrate a portion of a yet unsingulated assembly, which contains a plurality of identical assemblies.

Figure 37:
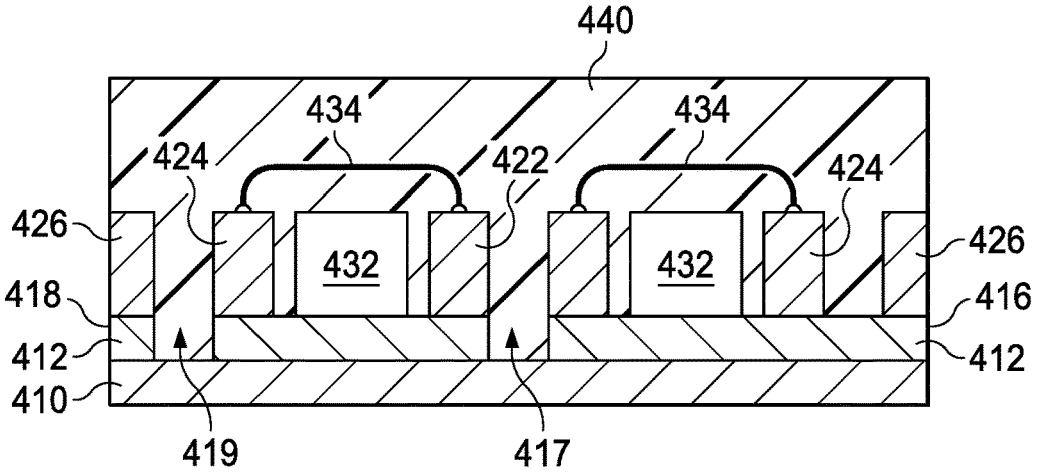

As shown in FIG. 37, each of the multiple assemblies, one of which is shown in FIG. 36, are then singulated by saw cuts, which pass through the outer ring of pillars 426 and the portion of the metal layer 412 and support layer 410 positioned immediately therebelow. These metal portions are exposed at a lateral side surface of the mold compound 440 block and may be used as terminals for one or more windings of the completed coil assembly 400 of FIG. 38A.

Figure 38A:
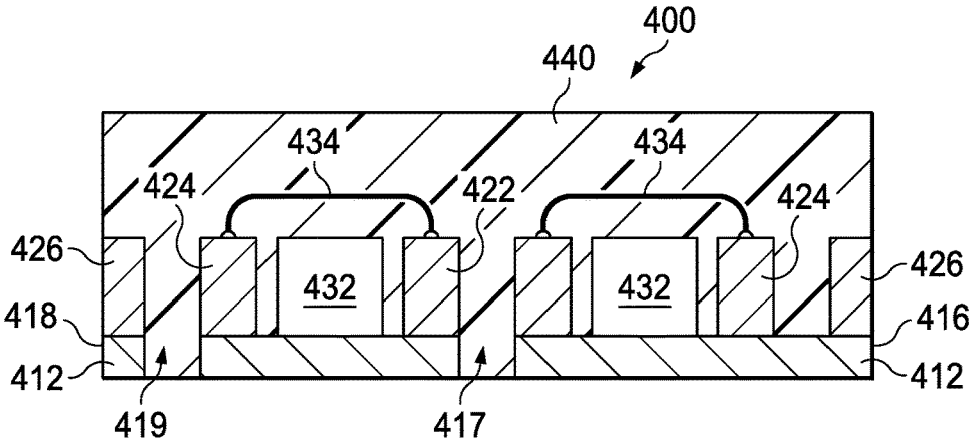
Figure 38B:
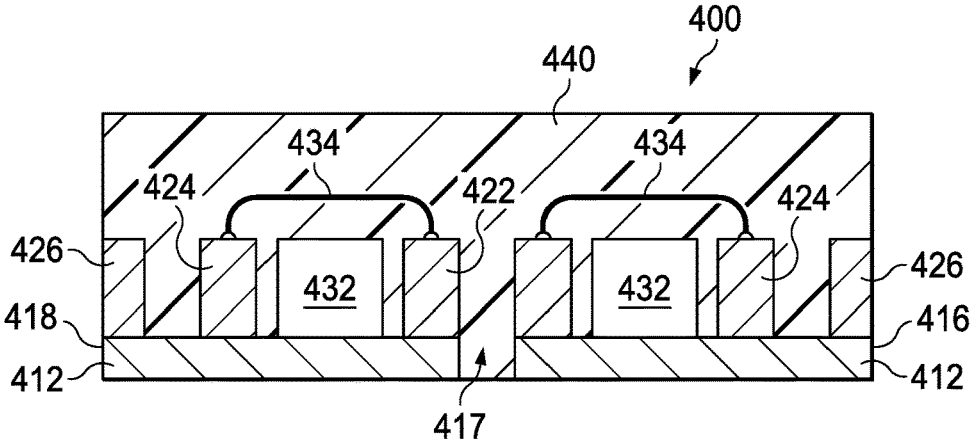
FIG. 38B is a side elevation view of an alternative structure to that shown in FIG. 38A.

A completed embedded coil assembly 400 is provided, as illustrated in FIG. 38A, by removal of the base layer 410 shown in FIG. 37.

An alternate embodiment of an embedded coil assembly 400 is illustrated in FIG. 388. The alternative embodiment is identical to that of FIG. 38A, except that the hole 419 is omitted.

Figure 39:
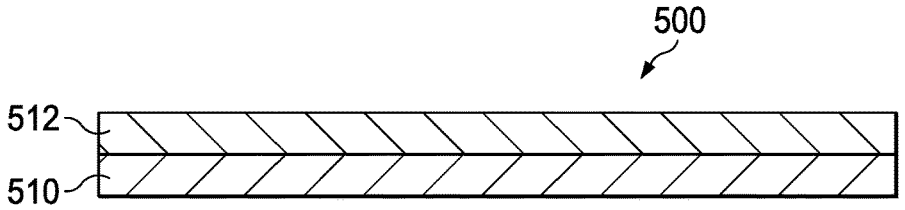
FIGS. 39 through 48 are cross-sectional side elevation views illustrating various stages in a further example method of producing an embedded coil assembly.
Figure 40:
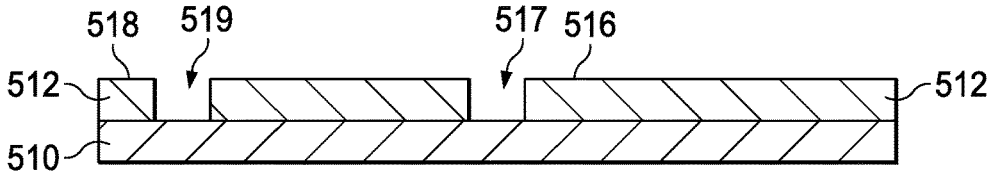

FIGS. 39-48 illustrate stages in the formation of another embedded coil assembly 500 similar to coil assembly 400. As shown in FIG. 39, a metal foil layer 512 is supported on a base layer 510. The foil layer 512 has circuitry patterned and etched thereon in the same manner as illustrated and described with reference to FIG. 32 to provide an annular main body portion 516 with hole 517 therein and an outer island portion 518 formed by a hole 519.

Figure 41:
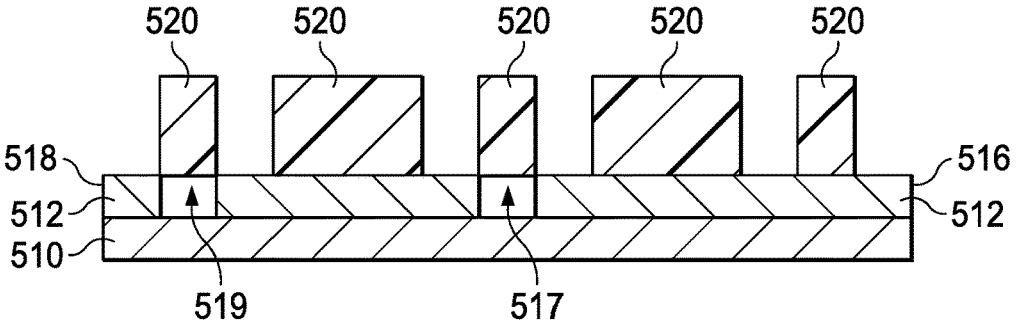
Figure 42:
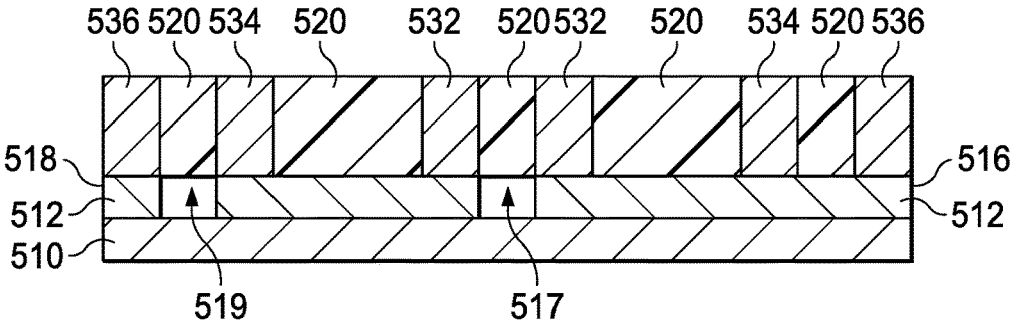

Next, as shown in FIG. 41, a non-sticky preformed mold 520 is placed on the metal foil layer 512. Then as shown in FIG. 42, metal powder is printed into the voids in the preformed mold 520 to provide a plurality of metal pillars 532 arranged in an inner ring, a plurality of metal pillars 534 arranged in an intermediate ring, and a plurality of metal pillars 536 arranged in an outer ring 536. The metal powder is then sintered or cured to form solid pillars.

Figure 43:
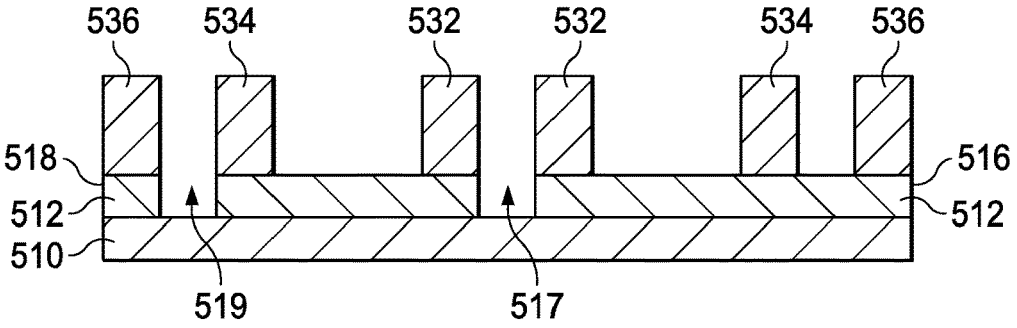
Figure 44:
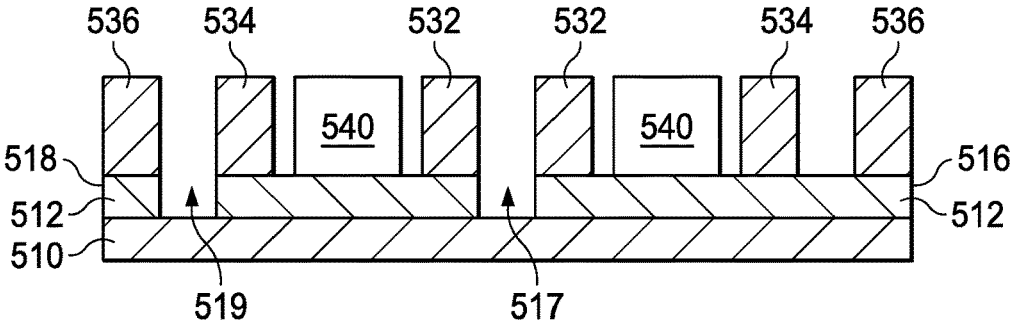

The preformed mold 520 is then removed as illustrated in FIG. 43, and a ferrite ring 540 is placed in the annular void between the plurality of pillars 532 in the inner ring and the plurality of pillars 534 in the intermediate ring, as shown in FIG. 44.

Figure 45:
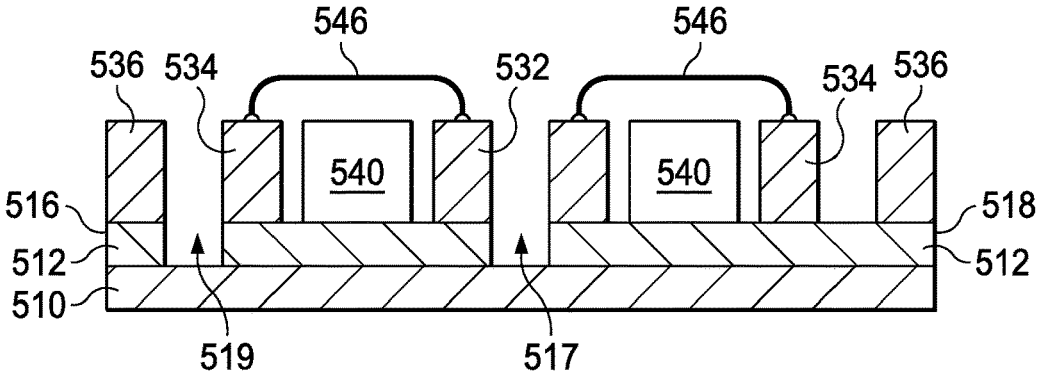
Figure 46:
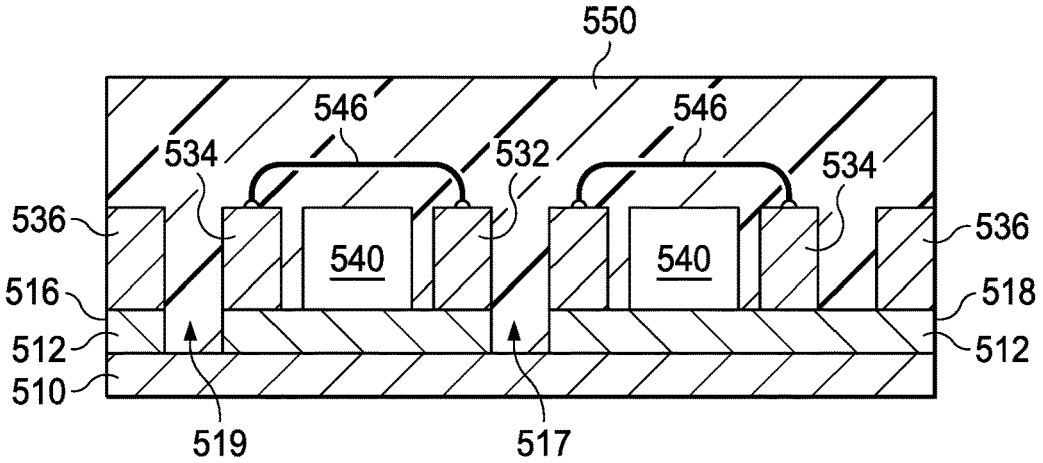
Figure 47:
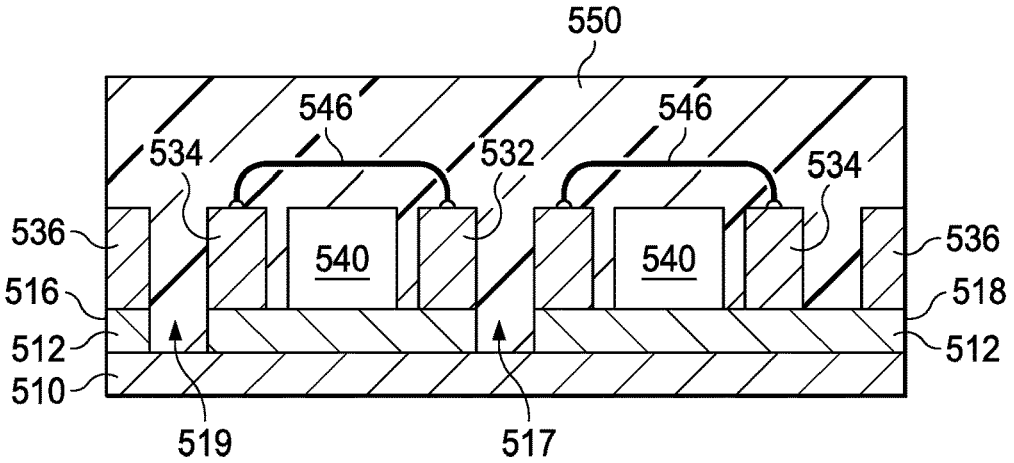

As illustrated by FIG. 45, bond wires 546 are then attached over the ferrite ring 542 aligned pillars in the inner ring of pillars 532 and the intermediate ring of pillars 546.

Next, the assembly of FIG. 45 has a layer of mold compound 550 applied thereto, which covers the metal layer 512, the inner, intermediate, and outer plurality of pillars 532, 534, 536, the ferrite ring 540 and the bond wires 546.

Figure 48:
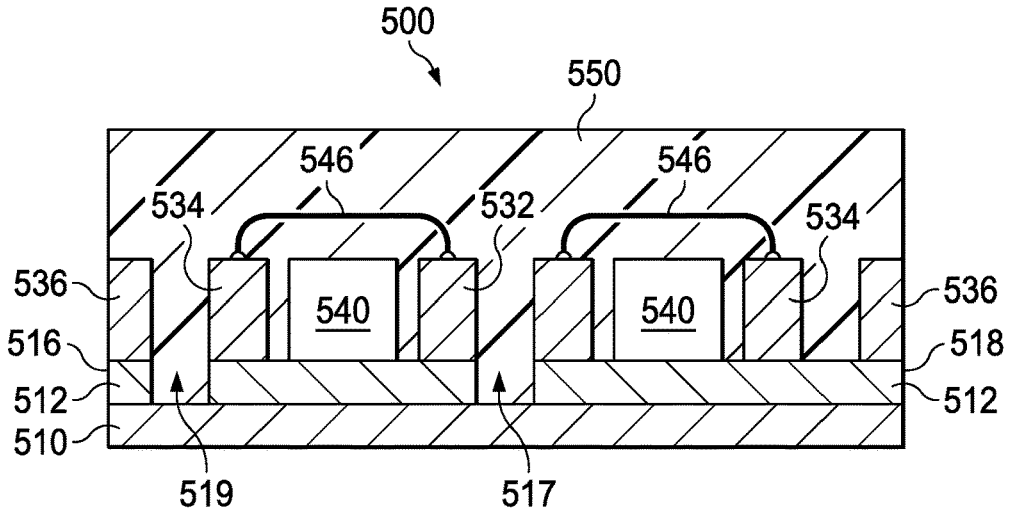

The base layer 510 is then removed to provide the completed embedded coil assembly 500, as illustrated by FIG. 48, which may be essentially identical to assembly 400 described above.

An alternative process for completing the production stages described with reference to FIGS. 33-37 and FIGS. 42-48, are illustrated in FIGS. 49-56. The end product made using this alternative process is the embedded coil assembly 600 illustrated in FIG. 56.

Figure 49:
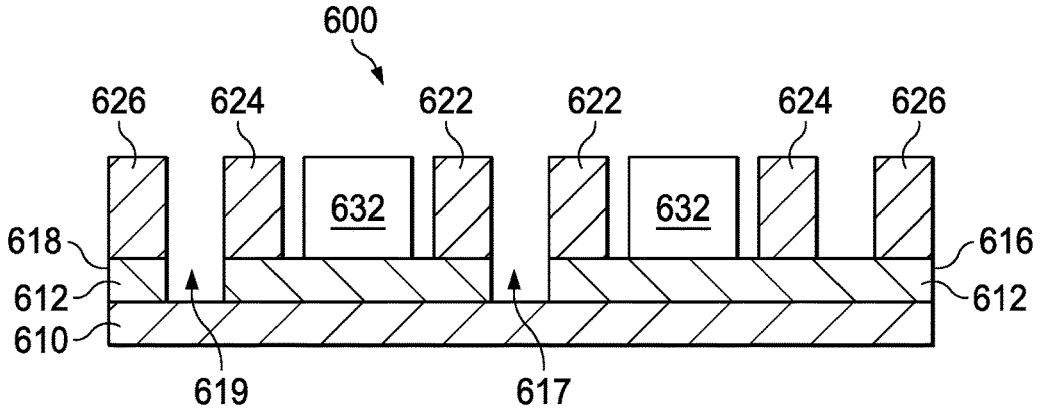
FIGS. 49 through 56 are cross-sectional side elevation views illustrating various stages in a still further example method of producing an embedded coil assembly.
Figure 50:
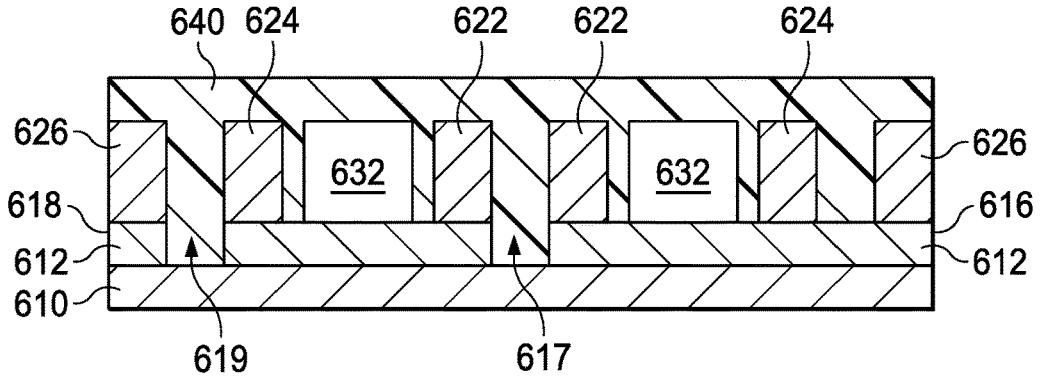

The process begins with an assembly as illustrated in FIG. 49 in which a support base layer 610 supports a patterned metal layer 612 that has been patterned and etched to provide a circuit having an annular main body portion 616 with a central opening 617 and a small outer Island portion 618 separated by a hole 619, i.e., the same pattern as described above, which forms a portion of embedded coil assemblies 400 and 500. An inner ring of metal pillar 622, an intermediate ring of metal pillar 624, and an outer ring of metal pillars 626 are formed on the surface of the metal layer 612, as shown in FIG. 49. A ferrite ring 632 is placed in an annular space between the metal pillars 622 in the center ring and the metal pillars 624 in the intermediate ring.

Next, the assembly shown in FIG. 49 is molded, as by a transfer mold to provide a layer of mold compound 640 that covers the metal layer 616, all of the metal pillars 622, 624, 626 and the ferrite ring 632, and fills the holes 617 and 619.

Figure 51:
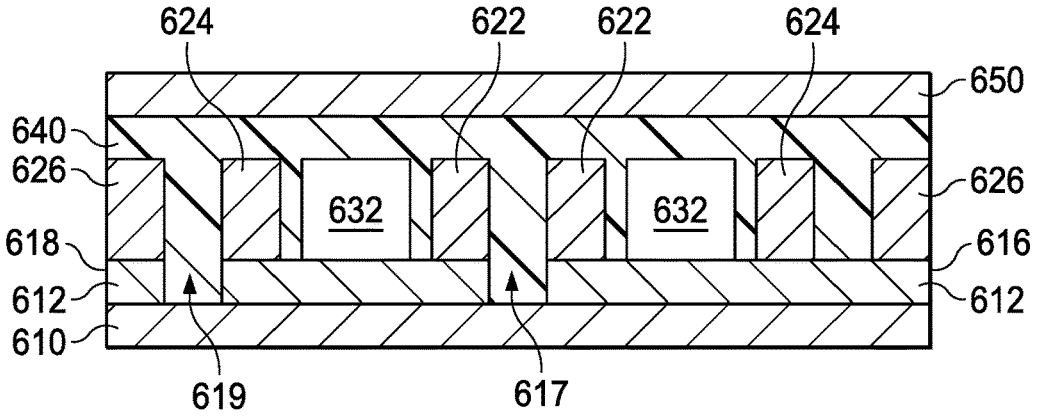
Figure 52:
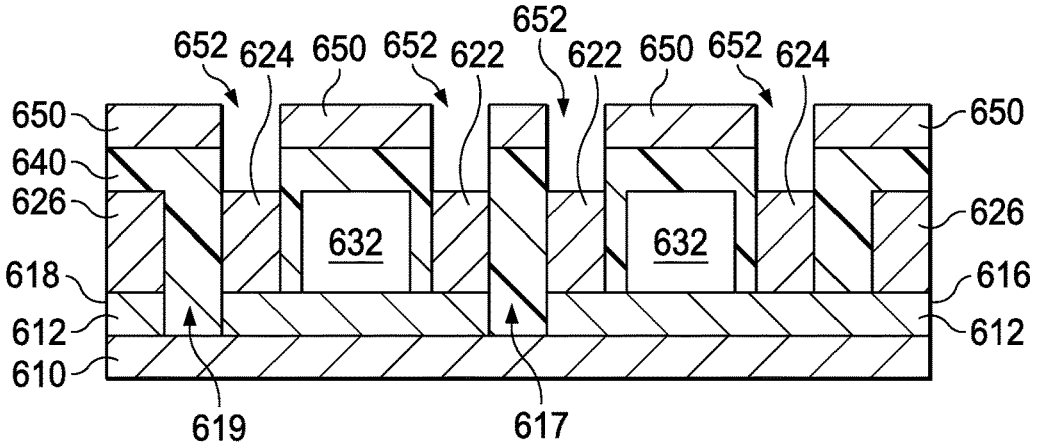

Next, as shown by FIG. 51, a metal layer 650, which may be a copper clad lamination layer, is formed on the top surface of the mold compound layer 640. As shown in FIG. 52 micro-vias 652 are then formed, as by using a laser, which extend through the top metal layer 650 and a portion of the mold layer 640 to the surface of each of the inner ring of metal pillars 622, and the intermediate ring of metal pillars 624.

Figure 53:
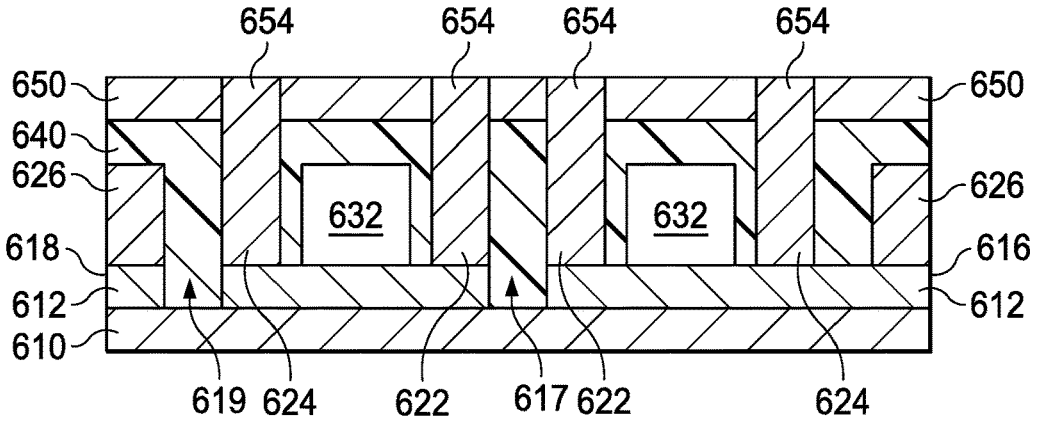

As illustrated in FIG. 53 the vias 652 are then metal plated to provide a continuous vertical metal path 654 extending from each of the pillars through the top plating layer 650.

Figure 54:
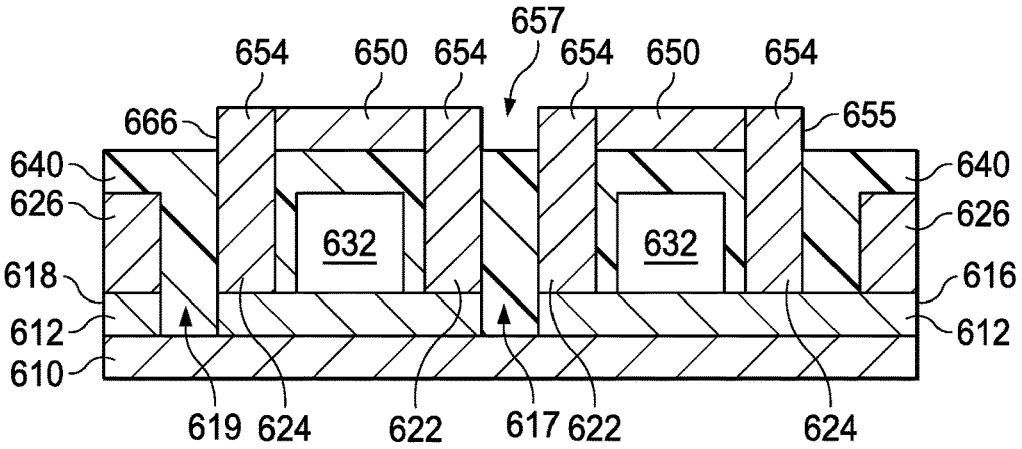

Next, as shown in FIG. 54, an outer annular portion 655 of the top plating layer 650 positioned outwardly of the intermediate pillars 624 is etched away, a central opening 657 is etched away and the top layer is further etched into a plurality of pie-shaped portion when viewed from the top, similar to the pie-shaped portions shown in FIG. 11B. As a result a plurality of bridge structures 666 are formed that are each comprised of a horizontal portion formed from layer 650 and two vertical end portions, formed by individual pillars 622, 624 and the filled vias 654 positioned thereabove. Each bridge structure 666 is generally pie-shaped as viewed from the top.

Figure 55:
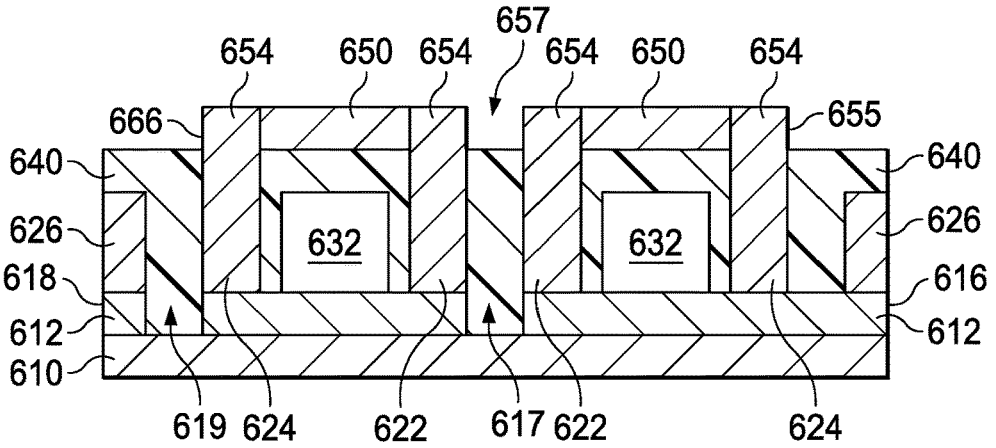
Figure 56:
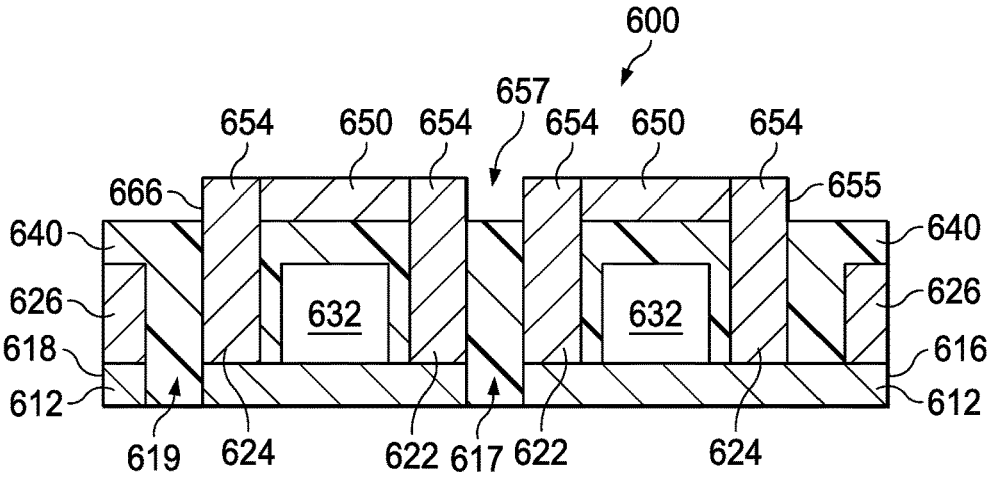

Next, as illustrated in FIG. 55, the assembly shown in FIG. 54 and adjacent assemblies are singulated. After that, the bottom layer 610 is removed leaving the completed embedded coil assembly 600 illustrated in FIG. 56. In this assembly, a metal bridge 666 extends between each pair of pillars 622, 624 in the inner pillar ring and intermediate pillar ring. Some of the pillars 626 in the outer pillar ring are exposed through the lateral sidewalls of the mold compound 640 by the singulation cuts. In another embodiment (not shown) an identical structure is provided, except that the hole 619 was not etched in the process described with reference to FIG. 49, and thus the finished assembly is symmetrical, i.e. there is no hole 619, and any of the exposed pillars 626 may be used for connection of external leads (not shown) to the coil assembly windings.

While copper has been described as a typical metal which may be used in the various metal layers and filled vias and bond wires, it will be appreciated by those skilled in the art that other conductive material such as silver or gold could provide the metal components described herein.

Figure 57:
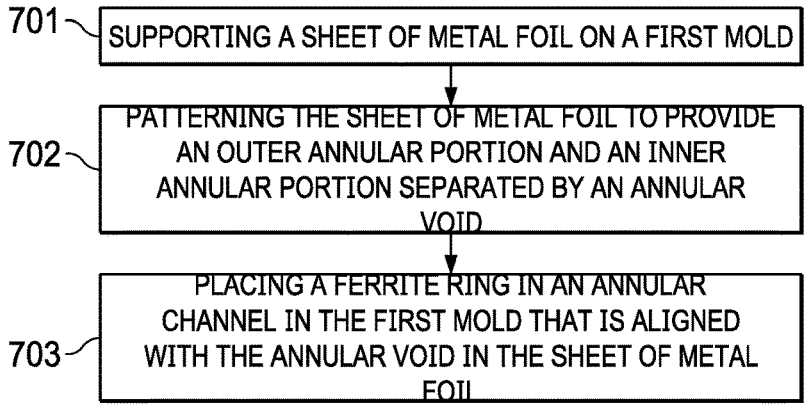
FIG. 57 is a block diagram of an example embodiment of a method of making an embedded coil assembly.

FIG. 57 illustrates an example method of making an embedded coil assembly. The method includes, as shown at block 701, supporting a sheet of metal foil on a first mold. The method also includes, as shown at block 702, patterning the sheet of metal foil to provide an outer annular foil portion and an inner annular foil portion separated by an annular void. The method includes, as shown at block 703 placing a ferrite ring in an annular channel in the first mold that is aligned with the annular void in the sheet of metal foil.

Figure 58:
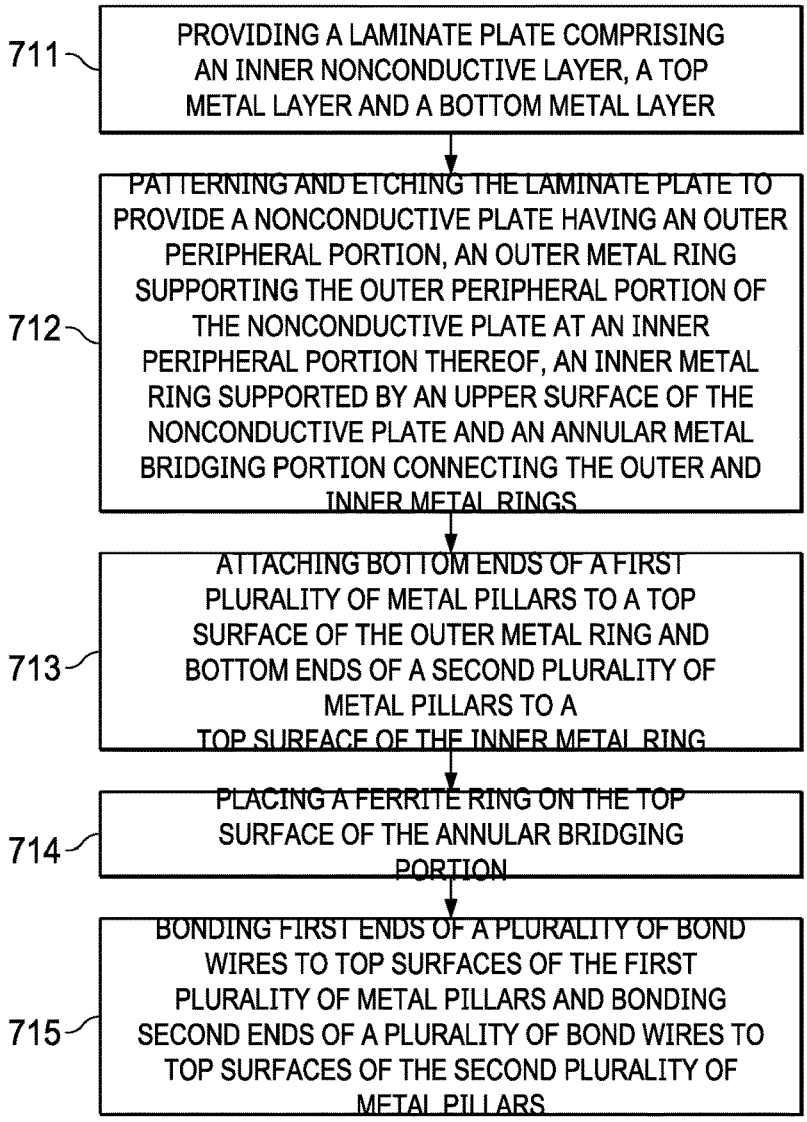
FIG. 58 is a block diagram of another example embodiment of a method of making an embedded coil assembly.

FIG. 58 illustrates another method of making an embedded coil assembly. The method includes, as shown at block 711, providing a laminate plate having an inner nonconductive layer, a top metal layer and a bottom metal layer. The method also includes, as shown at block 712, patterning and etching the laminate plate to provide a nonconductive plate having an peripheral portion, an outer metal ring supporting the outer peripheral portion of the nonconductive plate at an inner peripheral portion thereof, an inner metal ring supported by an upper surface of the nonconductive plate and an annular metal bridging portion connecting the outer and inner metal rings. The method also includes, as shown at block 713 attaching bottom ends of a first plurality of metal pillars to a top surface of the outer metal ring and bottom ends of a second plurality of metal pillars to a top surface of the inner metal ring. The method further includes, as shown at block 714, placing a ferrite ring on a top surface of the annular bridging portion. The method additionally includes, as shown at block 715, bonding first ends of a plurality of bond wires to top surfaces of the first plurality of metal pillars and bonding second ends of another plurality of bond wires to top surfaces of the second plurality of metal pillars.

Figure 59:
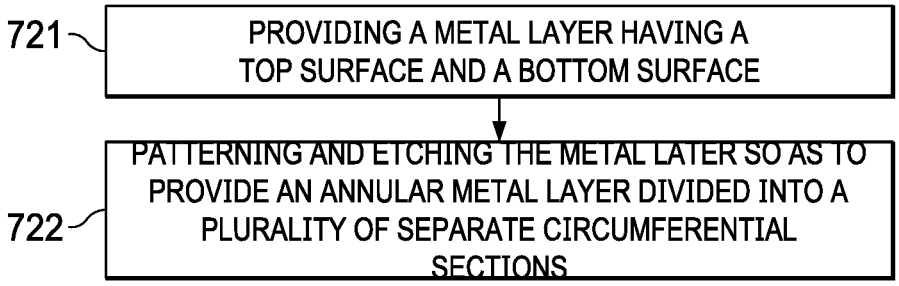
FIG. 59 is a block diagram of a further example embodiment of a method of making an embedded coil assembly.

FIG. 59 illustrates a method of making an embedded coil assembly. The method includes, as shown at block 721, providing a metal layer having a top surface and a bottom surface and patterning and, as shown at block 722, etching the metal layer so as to provide an annular metal layer divided into a plurality of separate circumferential sections.

Figure 60:
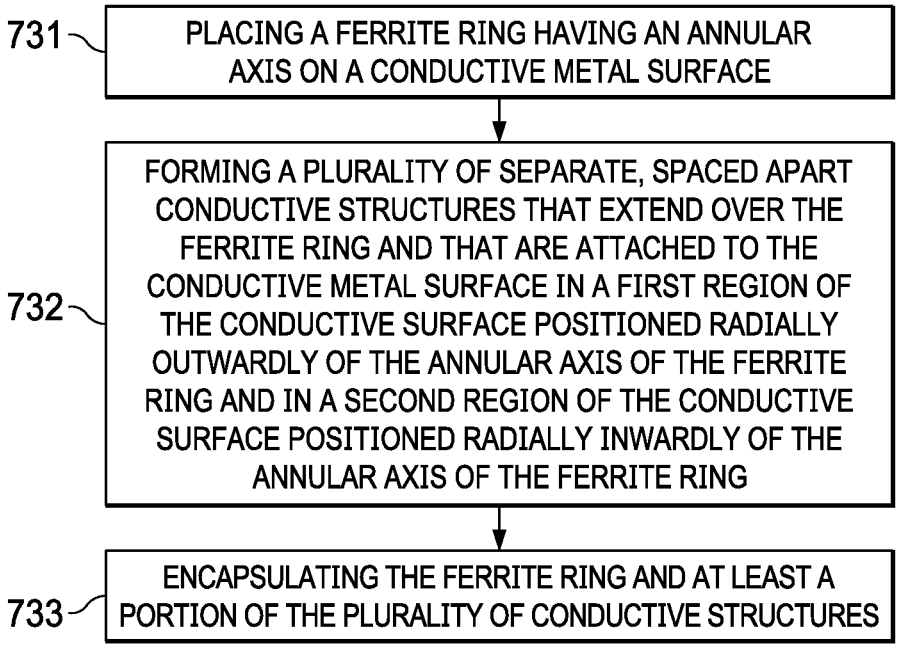
FIG. 60 is a block diagram of yet another example embodiment of a method of making an embedded coil assembly.

FIG. 60 illustrates a method of making an embedded coil assembly that includes, as shown at 731, placing a ferrite ring, which has a an annular axis, on a conductive metal surface. The method also includes, as shown at block 732, forming multiple separate, spaced-apart conductive structures that extend over the ferrite ring and that are attached to the conductive metal surface in a first region of the conductive surface positioned radially outwardly of the annular axis of the ferrite ring and in a second region of the conductive surface positioned radially inwardly of the annular axis of the ferrite ring. The method further includes, as shown at block 733, encapsulating the ferrite ring and at least a portion of the plurality of conductive structures.

Although certain embodiments of embedded circuit assemblies and production methods therefor have been expressly described in detail herein, other alternative embodiments will occur to those skilled in the art after reading this disclosure. It is intended for the language of appended claims to be broadly construed to encompass such alternative embodiments, except as limited by the prior art.

What is claimed is:

1. A method of making an embedded coil assembly comprising:

providing a metal layer having a top surface and a bottom surface;

patterning and etching the metal layer so as to provide an annular metal layer divided into a plurality of circumferential sections;

providing metal pillars onto the plurality of circumferential sections, each of the plurality of circumferential sections including an outer metal pillar, an intermediate metal pillar and an inner metal pillar on the metal layer;

electrically connecting the inner metal pillars and the intermediate metal pillars; and applying an encapsulant that covers portions of the metal layer, the annular metal layer, and the metal pillars to form the embedded coil assembly, wherein a vertical side of the outer metal pillar of each of the plurality of circumferential sections is exposed from the encapsulant of the embedded coil assembly.

2. The method of claim 1 wherein the outer metal pillar exposed from the encapsulant functions as a terminal of the embedded coil assembly.

3. The method of claim 1 wherein the patterning and etching the metal layer comprises patterning and etching the metal layer supported by a support plate.

4. The method of claim 1 wherein said patterning and etching separates an outer portion of at least one of the plurality of circumferential sections from the remainder of that circumferential section.

5. The method of claim 4 wherein providing the metal pillars comprises stencil printing metal powder onto the metal layer.

6. The method of claim 4 further comprising placing a ferrite ring on the top surface of the metal layer between the inner and intermediate metal pillars on each of the plurality of circumferential sections.

7. The method of claim 6 wherein the inner metal pillars and the intermediate metal pillars are electrically connected with a structure extending over the ferrite ring.

8. The method of claim 7 wherein the electrically connecting comprises electrically connecting the inner metal pillars and the intermediate metal pillars with a circuitry patterned on a layer of the encapsulant.

9. The method of claim 7 wherein the structure includes a bond wire.

10. The method of claim 7 wherein the applying of the encapsulant comprises covering the metal pillars of the plurality of circumferential sections, and at least a portion of the structure with a layer of the encapsulant.

11. The method of claim 10 further comprising connecting a circuitry to corresponding inner and intermediate metal pillars through plated vias.

12. The method of claim 10 further comprising removing the support plate after the covering.

* * * * *